United States Patent [19]

Aotsu et al.

[11] 3,956,637

[45] May 11, 1976

[54] INTERCEPT VALVE CONTROLLING METHOD AND SYSTEM FOR USE IN A HEAT POWER PLANT

[75] Inventors: Hiroaki Aotsu; Akira Isono; Yoshihiro Uchiyama, all of Hitachi, Japan

[73] Assignee: Hitachi, Ltd., Japan

[22] Filed: Dec. 18, 1973

[21] Appl. No.: 425,838

[30] Foreign Application Priority Data

Dec. 20, 1972 Japan ..... 47-127205

[52] U.S. Cl. ..... 290/40 R; 60/660; 290/52

[51] Int. Cl.[2] ..... H02J 1/10

[58] Field of Search ..... 290/40, 52, 2; 60/105

[56] References Cited

UNITED STATES PATENTS

| | | | |
|---|---|---|---|
| 3,421,014 | 1/1969 | Moorganov | 290/40 |
| 3,427,464 | 2/1969 | Watson | 290/40 |
| 3,609,384 | 9/1971 | Strohmeyer | 290/40 |
| 3,614,457 | 10/1971 | Eggenberger | 290/41 |
| 3,643,437 | 2/1972 | Birnbaum | 290/40 |
| 3,836,822 | 9/1974 | Schonfeld | 60/660 |
| 3,848,138 | 11/1974 | Park | 290/40 |
| 3,849,666 | 11/1974 | Park | 290/40 |

*Primary Examiner*—Robert K. Schaefer
*Assistant Examiner*—Joan W. Redman
*Attorney, Agent, or Firm*—Craig & Antonelli

[57] ABSTRACT

An intermediate intercept valve controlling method and system for use in a heat power plant wherein the occurrence of a fault in a transmission system is detected by an abrupt decrease in generator output, and the intercept valve is closed to a certain opening depending upon the magnitude of an output variation and is then opened when a rotor angle between the internal voltage and terminal voltage of the generator reaches the first peak value.

21 Claims, 28 Drawing Figures

FIG. 10 (64)
VIII
81
54
92
224
SC5
SC6
222
223
225
91
+Vcc
-Vcc
220
221
30
15
14
L2
REHEATER-EXIT PRESSURE DETECTING SIGNAL a-PHASE
b-PHASE
c-PHASE
13
70
a-PHASE
b-PHASE
c-PHASE
Tr
14
14
15
REHEATER-EXIT PRESSURE DETECTING SIGNAL
V
(FIG. 8)
OUTPUT OF 53
OUTPUT OF 52
VII
(FIG. 15)
OUTPUT OF 81
VI
(FIG. 12)
OUTPUT OF 213
X
(FIG. 19)
EMERGENCY GOVERNOR DRIVING SIGNAL
VALVE RE-OPENING SIGNAL
VALVE CLOSING SIGNAL

FIG. 27 (314,316 ,318)
FIG. 27 (315,317 ,319)
FIG. 25 (FET 6)
FIG. 25 (FET 7)
FIG. 24 (32)
FIG. 24 (32)
XII
305
306
307
SC11
SC9
SC10
E1
E2
+Vcc
-Vcc
FET 4
FET 5
FET 1
FET 2
FET 3
FF5
Q
SET
RESET
302
303
304
301
300
308
C1

INTERCEPT VALVE CONTROLLING METHOD AND SYSTEM FOR USE IN A HEAT POWER PLANT

The present invention relates to a method and its system for improvement in transient stability of a system in a heat power plant of a reheating and reproducing type, and more particularly to a method and its system for improvement in transient stability of a system in which an intercept valve is positively closed and opened to provide temporal suppression of a mechanical input to a generator.

When a fault occurs in a transmission system, the transmission line in which the fault is taking place is removed by means of a protective relay. During the fault, the generator is brought out of equilibrium in its input and output relations (i.e., a mechanical input is greater than an electrical output) with the result of the accelerated generator and unstable system. For improvement in transient stability of the system which is now in transient instability, various kinds of methods have been proposed; for example, in "WH Engineer" volume 30 - No. 4, July, 1970, published by a WH Company, there is disclosed a method for improvement in transient stability in the heat power plant of the reheating and reproducing type, in which an intercept valve is employed and disposed between a reheater and intermediate turbine. The "WH Engineer" describes the improvement of the transient stability by closing the intercept valve at the time of transient, and a well-known equi-area method by a braking resistor method. The particular controlling method of the intercept valve is such that the intercept valve is closed when the pressure at the exit of the reheater, which is proportional to the mechanical input to the generator, becomes out of equilibrium with generator output power and when the pressure at the exit of the reheater exceeds a predetermined level, and the valve is then opened when a predetermined time elapses therefrom. The intercept valve is opened only for backing-up, and hence it is opened after the lapse of the predetermined time from the closure of the valve in order to prevent the pressure at the exit of the reheater from being elevated due to the closure thereof. The reference only shows that the closure of the intercept valve effectively serves for improvement in transient stability.

On the other hand, there is required not only the improvement in stability at the time of the fault but also restoration to the normal operation of the generator as soon as possible from a point of view of system services.

An object of the present invention is to provide a method and system for improvement in transient stability of a system by using an intercept valve in a heat power plant of a reheating and reproducing type.

Another object of the present invention is to provide a method and system being capable of restoring a generator to a normal operation immediately after the circuit in which a fault occurred has been removed by cutting an associated circuit breaker off.

A further object of the present invention is to provide a method and system being capable of ensuring the safe operation of an intercept valve.

An intercept valve controlling method and system according to the present invention causes an intercept valve to be closed on the occurrence of a system fault and then opened at an optimum time for improvement in transient stability. A generator receives a mechanical input greater than the electrical output thereof during a period from the occurrence of the fault to the removal of the fault circuit with the result of the accelerated generator and instable system. The closure of the intercept valve, on the other hand, causes the electrical output to be greater than the mechanical input so that the generator receives a deceleration force. The intercept valve is opened when the acceleration force applied to the generator coincides with the deceleration force applied thereto. Accordingly, the generator is restored immediately to the normal operation with the improvement in transient stability.

Other objects and features will be understood when reading the following description and referring to the accompanying drawings, in which.

In the following, an intercept valve controlling method and system according to the present invention will be described.

Figure 1:
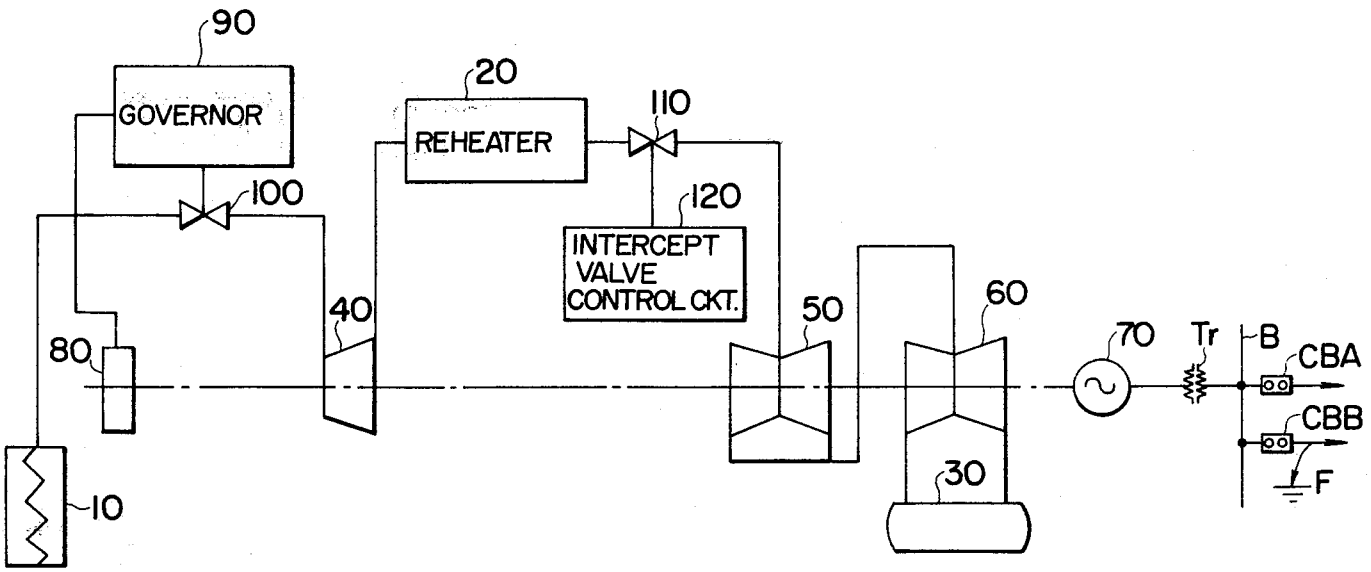
FIG. 1 is a schematic view showing a heat power plant including a reheater and an intercept valve to which the present invention is applicable and which is disposed between a high-pressure turbine and an intermediate turbine.

FIG. 1 shows a schematic view of a heat power plant. The intercept valve controlling system will be fully described in conjunction with FIG. 1 and FIG. 2 in which the characteristics of an inner rotor angle δ vs. generator output P are shown. In FIG. 1 there are shown a high-pressure turbine 40, an intermediate-pressure turbine 50 and a low-pressure turbine 60, an input flow of steam from a boiler 10 to the high-pressure turbine 40 being controlled by operating a control valve 100 through a speed detector 80 disposed on the same axis as that of these turbines and through a governor 90. The steam derived from the high-pressure turbine 40 is introduced to the intermediate-pressure turbine 50 through a reheater 20 and an intercept valve 110. The steam generated from the high-pressure turbine 40 is once heated by the reheater 20, the thermal capacity of which has a greater ratio than that of the boiler 10. For this reason, a portion of input energy to a generator 70 is effectively controlled by the intercept valve to suppress the acceleration of the generator. The steam drained from the intermediate-pressure turbine 50 is introduced to a condenser 30 through the low-pressure turbine 60.

The generator 70 is, on the other hand, driven by these turbines to produce an output, which is connected to a transmission system through a primary transformer Tr, a bus B and circuit breakers CBA and CBB. The heat power plant has the above-mentioned arrangement. An intercept valve control 120 according to the present invention is carried out, for example, in such a case where a fault occurs at a point F on a transmission line and the generator 70 rapidly decreases in output due to the cutting-off of the circuit by protective relays and is then accelerated due to the unbalance between its output and input with the result of instability thereof because of an increased rotor angle between the generator and a power receiving terminal (infinite bus). In the present invention, the opening of the intercept valve 110 is controlled to close temporally to suppress the mechanical input of the generator 70 with sufficient suppressive force for improvement in transient stability. It is to be noted that the output of the generator is shown in FIG. 1 as having a signal line but actually has a three-phase line.

Assuming, here, that $E_Q$ is an internal voltage of the generator 70, V a voltage at the power receiving terminal, δ the rotor angle therebetween and XL transfer impedance therebetween (including synchronous reactance of the generator, impedance of the primary transformer Tr and impedance of the transmission line), then the output power from the generator 70 can be expressed as well known as follows:

$$P = \frac{E_Q \cdot V}{XL} \sin \delta$$

The following description will be made by way of a two-circuit transmission line for convenience of the description.

The transfer impedance depends on system conditions such as normal two-circuit operation, single circuit operation after the removal of the fault circuit, or operation during the fault, and it has a smaller value in that order. Accordingly, the relation of the output P from the generator to the rotor angle δ are shown by curves I to III in FIG. 2 on the assumption that $E_Q$.V is constant.

Figure 2:
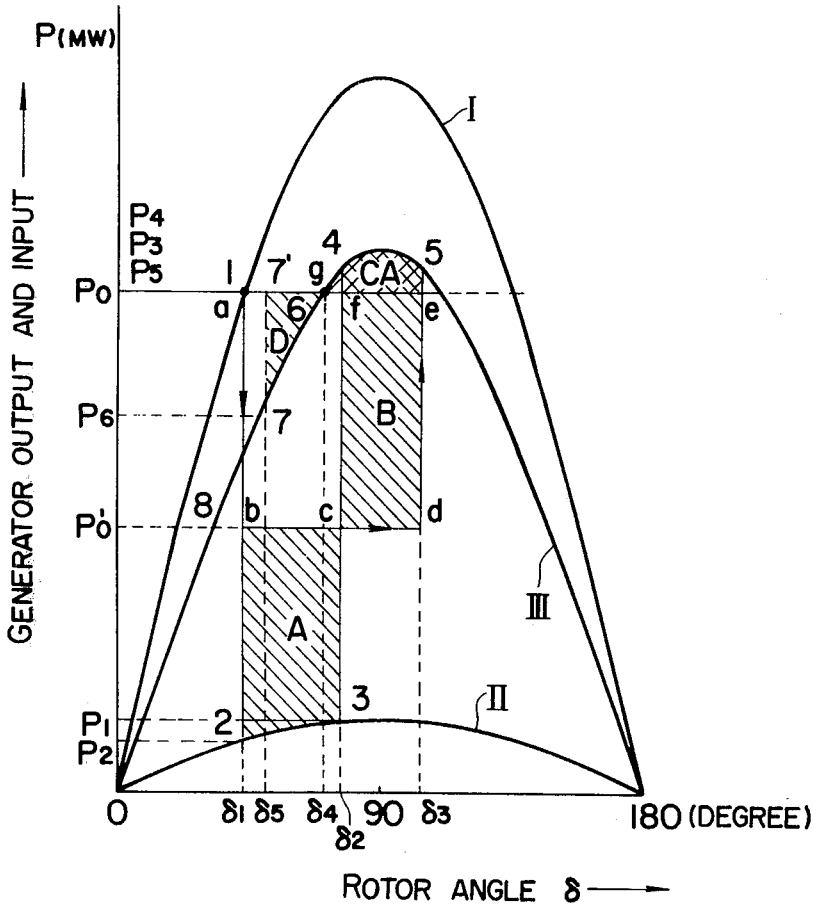
FIG. 2 is a graph of generator output P vs. inner rotor angle $\delta$ characteristics for illustrating an improvement in transient stability by using an intercept valve.

In FIG. 2, the lapse of the generator input is represented by *a, b, c,* . . . while that of the generator output is represented by 1, 2, 3, . . . in order to provide the detailed description of fluctuation in rotor angle at the time of the cutting-off of one circuit in the transmission lines.

In FIG. 2, let $P_o$ be the generator output at the normal operation, and a balancing point of stability lies on $\delta_1$ and at an intersection I of the P - δ curve I with $\delta_1$. In this state, a system fault is assumed to occur, and then the generator output P shifts to an intersection 2 of the P - δ curve II with $\delta_1$. It is now assumed that the characteristic of the intercept valve is ideal and hence has no retardation factor, and that the generator input is caused to receive an abrupt displacement from $P_o$ (point *a*) to $P_o'$ (point *b*) by rapidly closing the intercept valve on the occurence of the system fault. Let P ($P_2 \leq P \leq P_1$) be a generator output of the P - δ curve II at the time of the fault, and the generator input $P_o'$ is greater than the generator output P, so that the generator receives an acceleration force with the result of the increased rotor angle δ. At a time when the rotor angle reaches $\delta_2$, the fault circuit is removed by a protective relay in the system, and then the generator is transferred to the single-circuit operation with its output shifted to an intersection 4 of the P - δ curve III in the single-circuit operation with $\delta = \delta_2$. Even at this point, the intercept valve continues to be retained in the interrupted state with the generator input $P_o'$ smaller than the generator output P, so that the generator beings to undergo deceleration instead of receiving acceleration. The rotor angle δ of the generator advances until deceleration energy shown by an area B (enclosed by *c* - *d* - 5 - 4) is obtained which compensates for an area A (enclosed by *b* - 2 - 3 - *c*), that is, acceleration energy generated from the occurrence (position $\delta_1$) of the fault to the removal of the fault circuit (position $\delta_2$).

Thus, the closing of the intercept valve on the occurrence of the fault in the transmission line permits the input to and output from the generator to be controlled to suppress the fluctuation in the inner rotor angle δ of the generator. When, however, the intercept valve remains closed, the system is supplied with no sufficient electric power.

According to the present invention, on the other hand, at the timem when the area A becomes equal to the area B (that is, at the rotor angle of $\delta_3$), the intercept valve is re-opened to the original position to restore the generator input P from $P_o'$ to $P_o$. In this state, if the output $P_o'$ is previously set so that the generator output P may be greater then $P_o$, then the generator initiates a damped oscillation toward an equilibrated point 6 ($\delta_4$) of stability, that is, an intersection of the P - $\delta$ curve III with $P_o$. It is to be noted that the generator output P is greater than the generator input $P_o$ upon restoration to the single-circuit operation (P - $\delta$ curve III) with the accelerating energy corresponding to an area CA defined by *e* - 5 - 4 - 6 and with the decelerating energy corresponding to an area D defined by 6 - 7' - 7 which is equal to the area CA. Accordingly, the rotor angle $\delta$ using the intercept valve controlling system according to the present invention fluctuates from a maximum $\delta_3$ to minimum $\delta_5$ with the oscillation attenuated with the balancing point $\delta_4$ of stability. In this way, the intercept valve controlling serves to improve the transient stability of the system.

It is undesirable that the intercept valve remains interrupted longer than required because it would be preferable to make as little fluctuation after the second oscillation as possible to suppress the fluctuation affecting the system, and to restore the generator output before the fault as soon as possible after the removal of the fault circuit. In other words, if the intercept valve remains closed as conventionally, then the balancing point of stability after the removal of the fault circuit is an intersection 8 of the P - $\delta$ curve III with $P_o'$. For this reason, the generator receives a further deceleration force by an amount of an area enclosed by 8 - *b* - *c* - *d* - 5 - 4 - 6 - 7 after reaching a peak rotor angle $\delta_3$ with the area A being equal to the area B, and thus it has its rotor angle $\delta$ reduced until it obtains the acceleration area compensating for that area. As the case may be, the rotor angle $\delta$ extends as far as over a negative region (a region of operation of a synchronous motor), resulting in the greatly increased amplitude of the fluctuation in the generator output after the second oscillator with the unfavorable disadvantages to the system.

Figure 3:
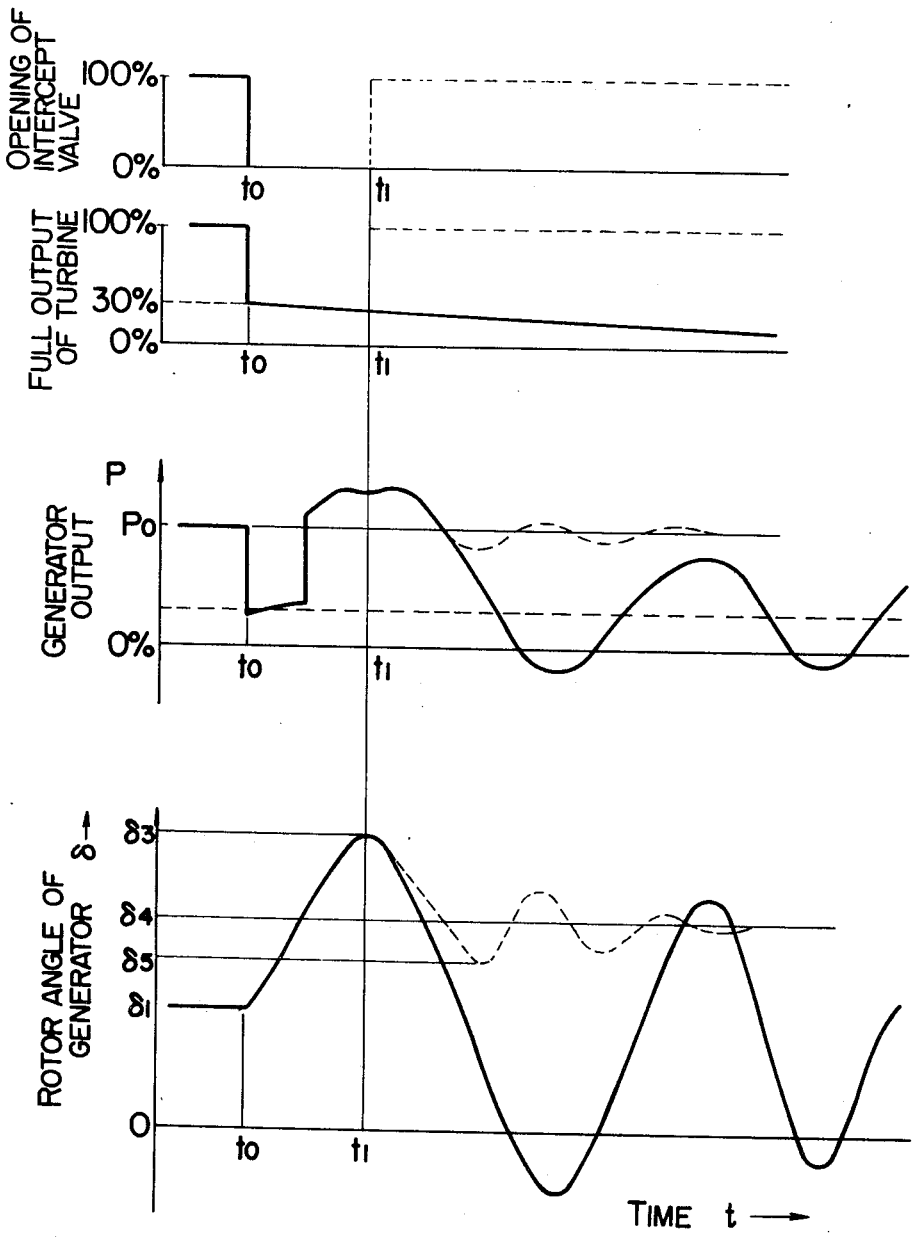
FIG. 3 is characteristic graphs showing a difference of transient stability between a case where an intercept valve having ideal characteristics is assumed to continue to close at the time of a system fault and a case where the intercept valve is again opened at a rotor angle peak.

FIG. 3 shows a full output from the generator, the generator output P and the fluctuations in rotor angle $\delta$ when the intercept valve is opened to the original position after the closure thereof (shown by dotted lines) and when it remains closed (shown by solid lines). It is to be noted that in FIG. 3 the intercept valve is illustrated as being assumed to effect ideal operations without any time lag. From the figure it will be appreciated that the generator output P and the fluctuation in rotor angle $\delta$ fluctuates greatly after the second oscillation with the great adverse influence upon the system in the intercept valve which remains closed as compared with that in the intercept valve which is again opened. The reason why the full output of the turbine assembly decreases to 30 % due to the complete closure of the intercept valve (at a time $t_o$) is based on the fact that a ratio of the full output of the turbine assembly to the output sum of the intermediate and low-pressure turbines is selected to be 10 to 7.

Figure 4:
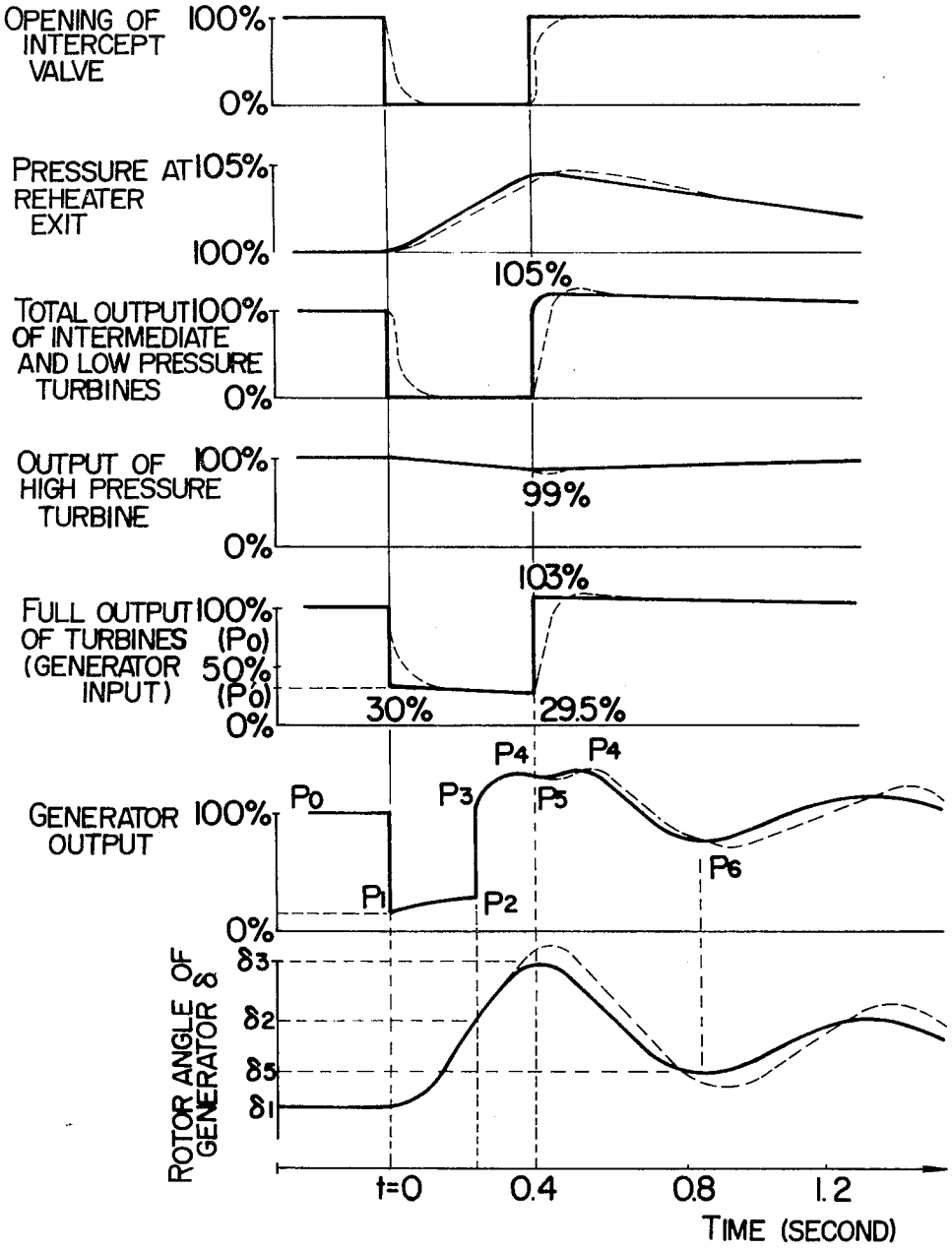
FIG. 4 is characteristic graphs showing each state of the plant when an intercept valve control is effected using an actual intercept valve.

Further, FIG. 4 shows graphs in which there is illustrated a difference between the ideal valve (shown by solid lines) and the actual valve (shown by dotted lines) the characteristic of which has been taken into account. When the intercept valve is completely closed about 0.4 second, the pressure at the exit of the reheater increases up to 105 %, which, however, never produces any danger to the reheater. In general, the operation of a blow-off valve due to the elevation of pressure is initiated by an increase in rated pressure up to 110 %.

Figure 6:
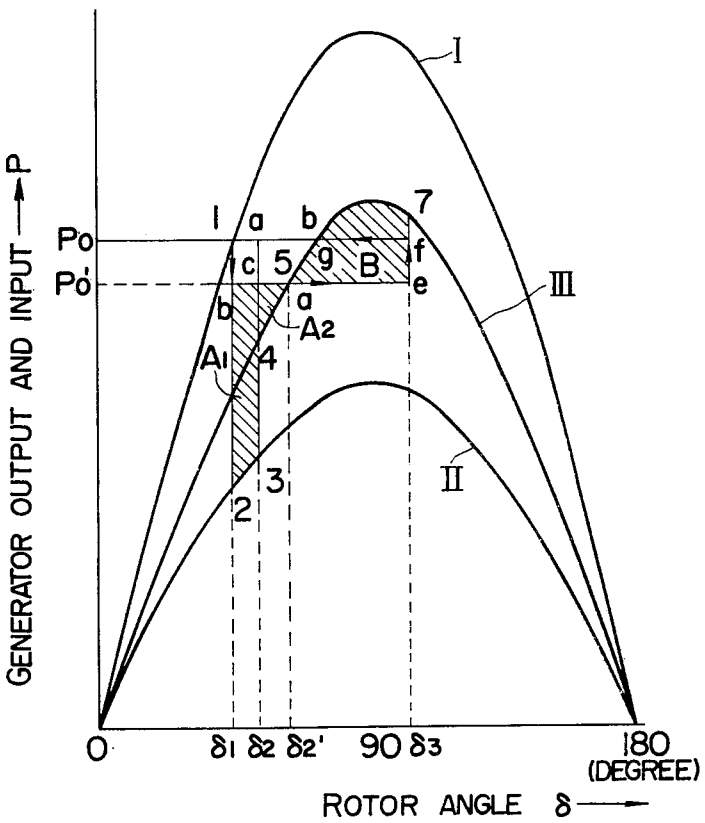
FIGS. 5 and 6 are P - $\delta$ characteristic graphs obtained when a valve opening is adjusted depending upon the degree of a system fault.
Figure 5:
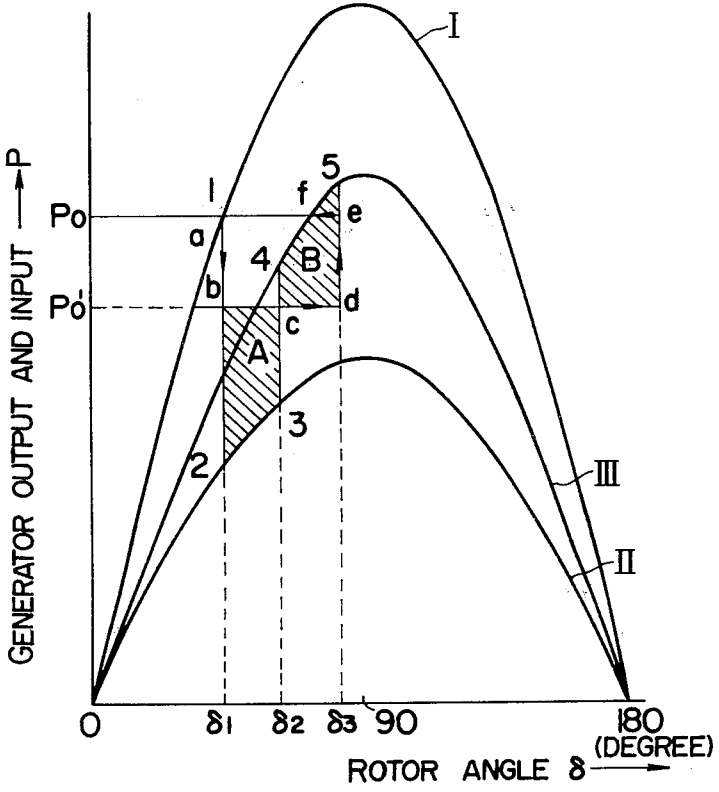

As mentioned above, the intercept valve controlling system has sufficient reliability and serves to improve the transient stability of the plant and system. Further the intercept valve controlling permits the fluctuation in rotor angle to be suppressed at minimum by adjusting the opening of the valve depending upon the degree of the system fault as will be seen from FIG. 5 or 6.

Figure 7:
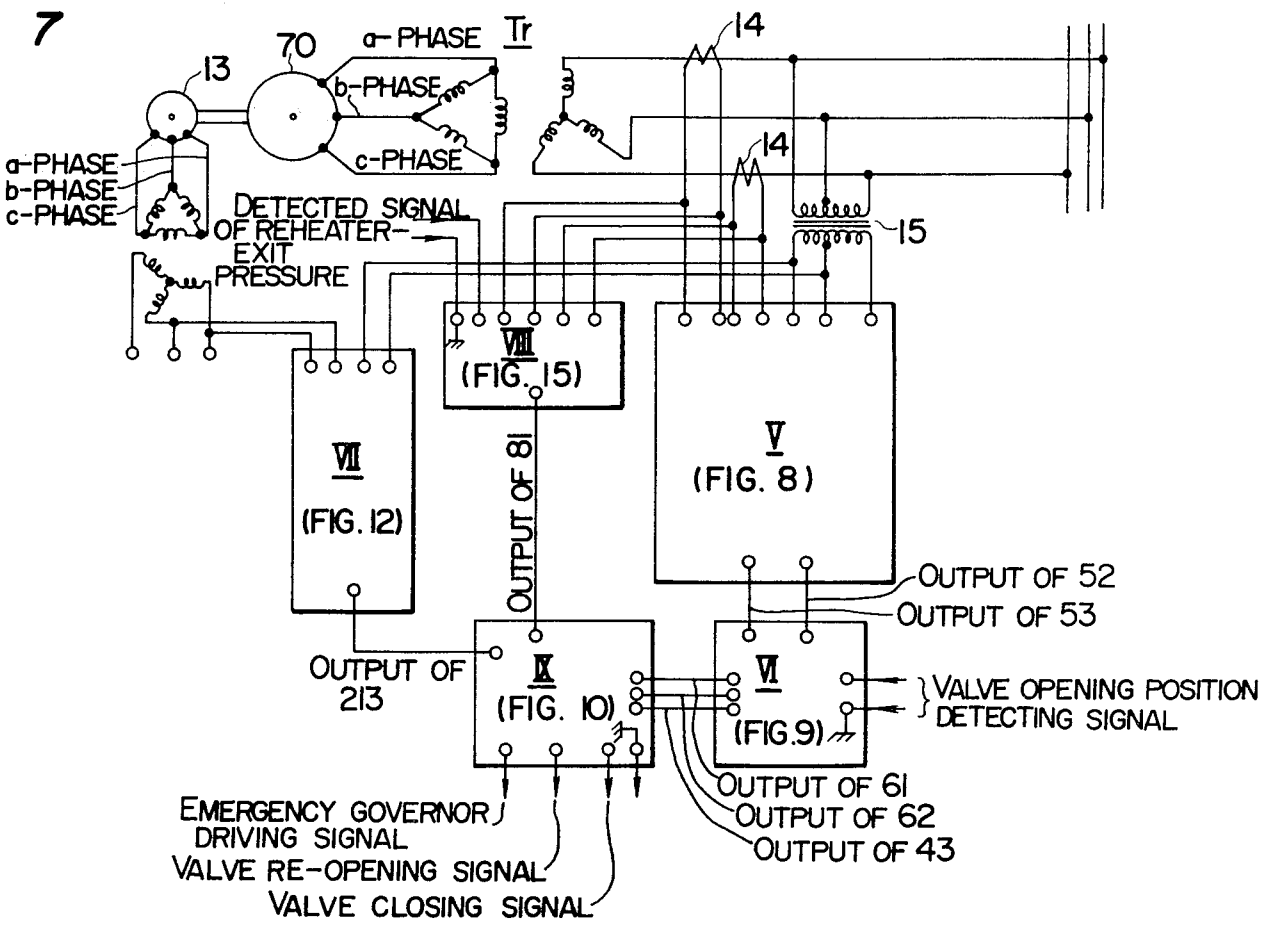
FIG. 7 is a block diagram for use in adjusting the valve opening depending upon the degree of a system fault.

FIG. 7 shows a block diagram of a particular embodiment of the intercept valve circuit according to the present invention, in which the opening of the intercept valve is controlled depending upon the variation of detected power to detect a variation rate of the rotor angle $\delta$ and to open the intercept valve again at the zero point of the variation rate, i.e., at the first peak point of the rotor angle. Note that portions or blocks of FIG. 7 marked with the same references as those of FIG. 1 indicate the same or equivalent portions or blocks of FIG. 1. In the figure, a block V serves as a block for detecting a system fault which provides an output when it receives an abrupt variation of power to thereby judge it as the system fault. A block VI serves to determine the opening of the intercept valve in response to the output from the block V. A block VII for detecting the first peak rotor angle detects the rotor angle between the internal voltage of the generator 70 and the voltage at the power receiving terminal and generates an output when it becomes a peak value first. A block VIII serves as a backup block for opening the intercept valve in an emergency to protect the heat power plant. A block IX serves to control the intercept valve in response to the outputs from the blocks V, VI, VII and VIII. In the following, each block will be described in detail by way of particular circuits.

Figure 8:
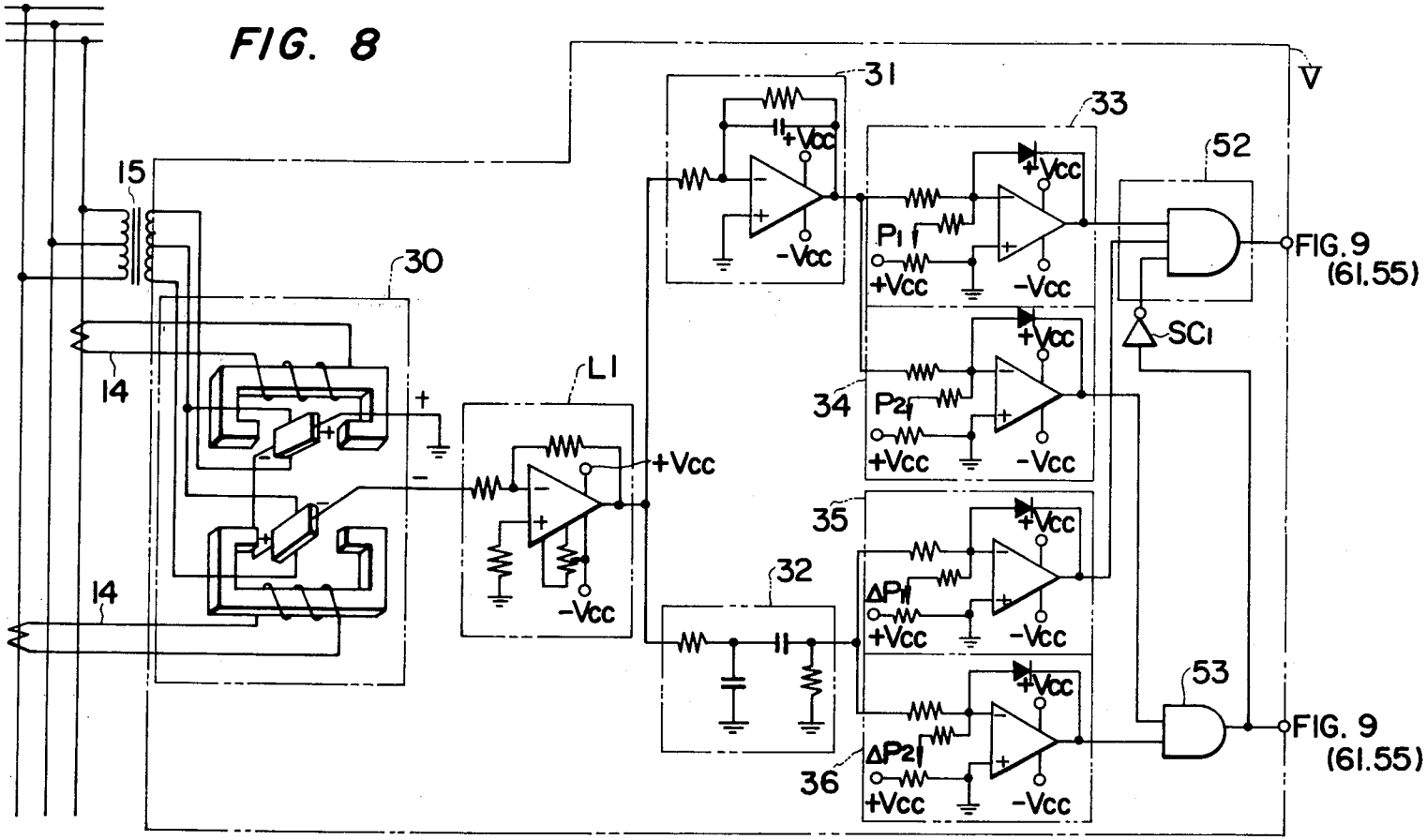
FIG. 8 is a particular circuit arrangement view of a system-fault detecting block V in FIG. 7.

FIG. 8 shows the block V, which detects the generator output by means of the power detector 30 such as a Hall converter through a current transformer 14 and a transformer 15. The output from the detector 30 is applied to a level memory 31 and a power variation detector 32 through a level converter $L_1$. The level memory 31 memorizes the electric power in a state of equilibrium prior to the occurrence of the system fault and is, for example, constituted by a level amplifier having a timing delay (for example a first order lag circuit), holding the level before the output variation without showing any immediate response to the output variation of the power detector 30. The power variation detector 32 serves to produce an output proportional to a magnitude $\Delta P$ of the power variation, that is, a difference between the power in the normal operation and that after the variation. The detector 32, for example, generates the output proportional to $\Delta P$, which is derived from the deviation of the output of a circuit having a greater time constant and retaining a value prior to the power variation from that of a circuit having a smaller time constant and having a prompt response to the power deviation.

Figure 9:
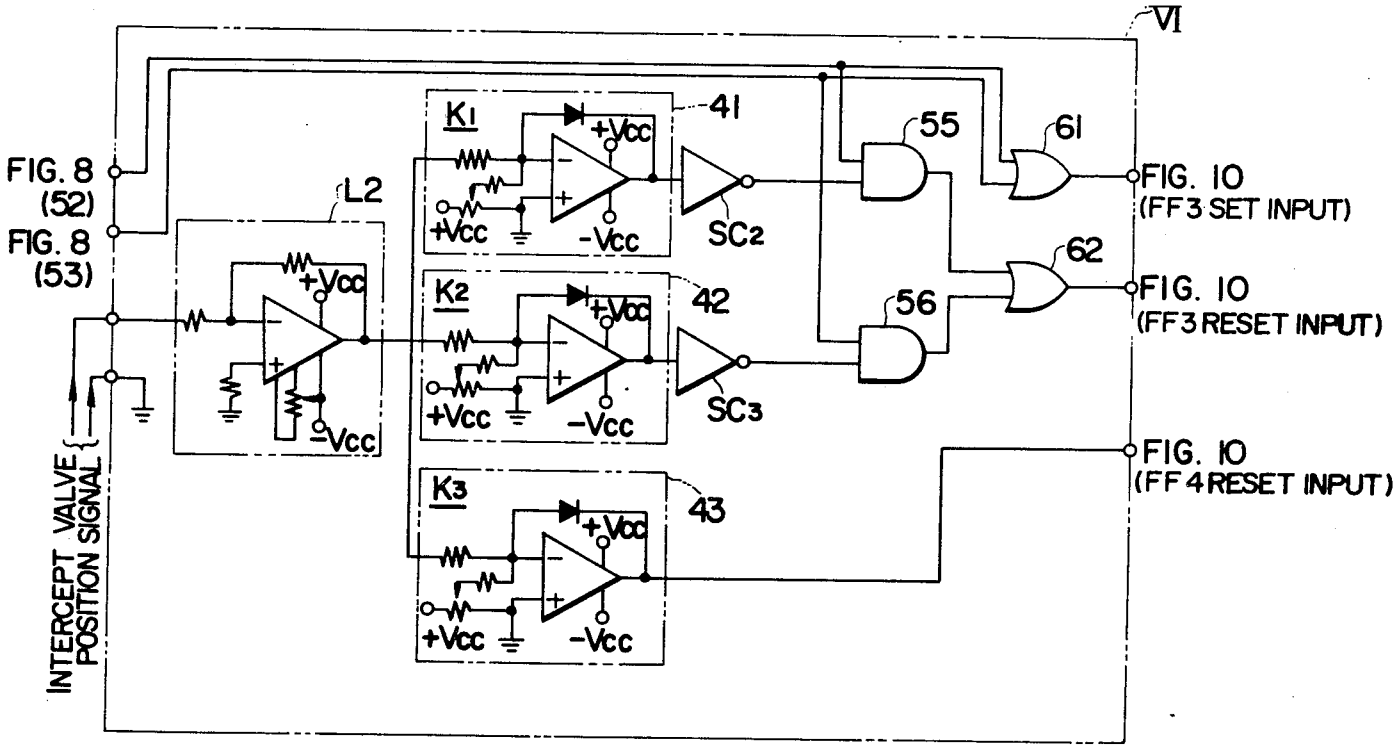
FIG. 9 is a particular circuit arrangement view of a valve-opening determining block VI in FIG. 7.
Figure 11:
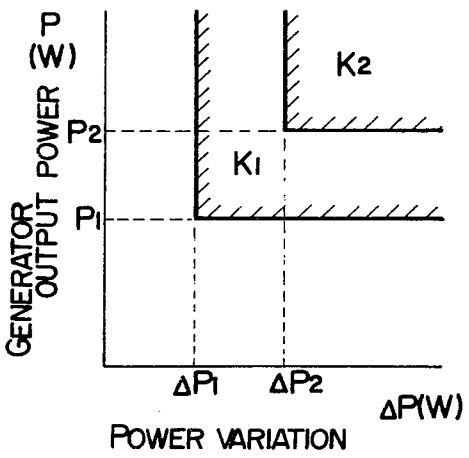
FIG. 11 is a characteristic graph for obtaining valve opening depending upon normal power and a power variation due to a fault.
Figure 10:
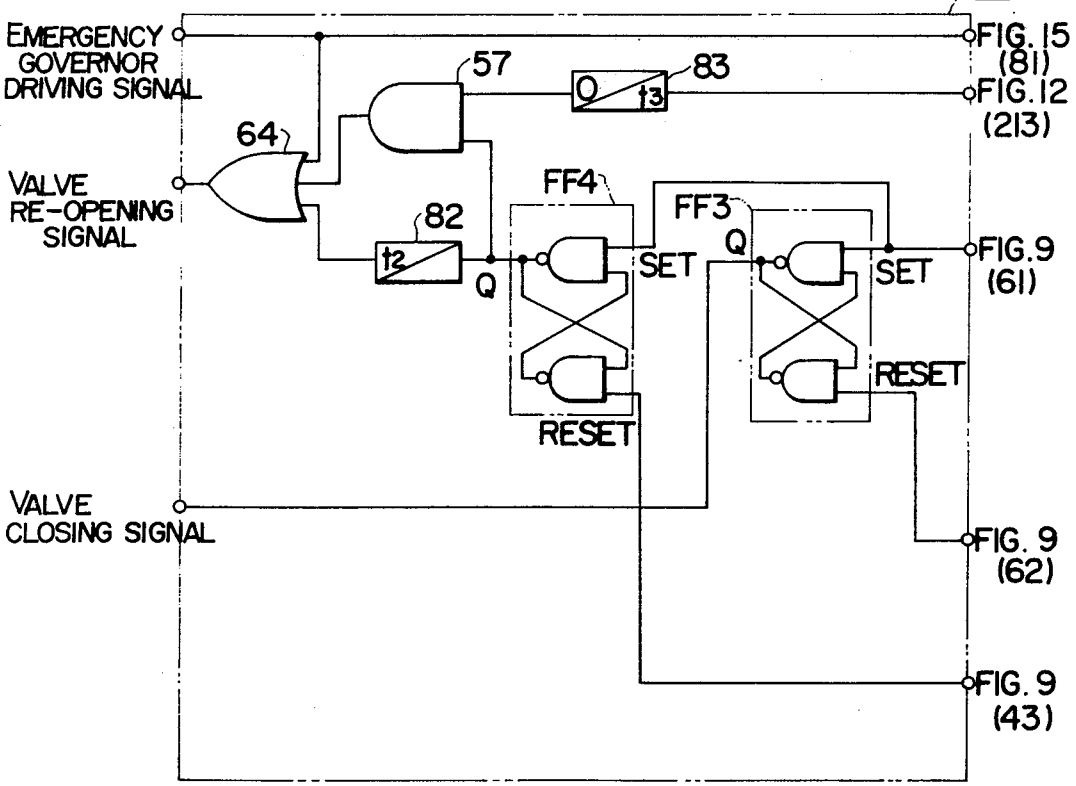
FIG. 10 is a particular circuit arrangement view of a block IX for controlling the opening and closing of the intercept valve in response to the output from each block in FIG. 7.

The output from the circuit having the greater time constant is now assumed to be subtracted from the output from the circuit of the smaller time constant by the reason of convenience of the following description, according to which comparators are defined to have a negative input voltage. In the figure, this is constituted by a filter 32 including an integrating filter of a small time constant and a differentiating filter connected thereto in cascade. Accordingly, the filter circuit 32 has the positive input voltage (the Hall converter 30 having the negative output and the level converter $L_1$ having the positive output), and the negative voltage is derived therefrom on the occurrence of the system fault (with the generator output decreased). Thus, the generator output P and output variation $\Delta P$ are derived. Comparators 33 to 36 generate outputs at the generator outputs above $P_1$ and $P_2$ and at the output variation above $\Delta P_1$, $\Delta P_2$, respectively. It is to be noted that a relation of $P_1 > P_2$, $\Delta P_1 > \Delta P_2$ is assumed. The comparators 33 to 36 include operational amplifiers having two input terminals, respectively, to one of which there is applied a set voltage generated by dividing a driving power supply voltage $V_{cc}$ in dependence on a level to be detected. On the other hand, to the respective other input terminals there are applied the voltages corresponding to the generator outputs and voltages corresponding to the polarity and the magnitude of the output variations. Thus the comparators provide the output when they receive the input above the level to be detected. AND circuits 52 and 53 produce outputs, which mean that the abrupt fluctuation (fault) has taken place in the generator output. The outputs are applied to the block VI for determining the opening of the intercept valve. The particular circuit of the block VI is shown in FIG. 9. The outputs from the AND circuits 52 and 53 are applied to AND circuits 55, 56 and OR circuits 61, and are applied to the set terminal of a flip-flop FF3 in the block IX (FIG. 10) through the OR circuit 61. The output terminal Q of the flip-flop FF3 is turned to logic I when the set terminal is triggered. The output Q from the flip-flop FF3 serves to instruct the intercept valve to be closed. As mentioned above, when the generator output undergoes the fluctuation, the intercept valve is instructed to be closed for the first time. In FIG. 9, a signal representative of the opening position of the intercept valve is introduced and has a function to hold the intercept valve in a predetermined opening position when it is closed to the predetermined opening position under the instruction generated in response to the fault. The opening position at which the intercept valve is to be held is previously set depending on the output power prior to the fault and the level of the power fluctuation. In general, when the normal power $P_o$ is small, the reduction rate of the mechanical input $P_o'$ may be small in accordance with the small acceleration force in the single-circuit operation. For this reason, in the present invention, the mechanical input is controlled, as shown in FIG. 11, by a suitable amount by selecting the opening positions, for example, $K_1$, $K_2$, to which the intercept valve is to be closed with the normal powers $P_1$, $P_2$ prior to the fault in combination with the power variation $\Delta P_1$, $\Delta P_2$ immediately after the fault.

Referring to FIG. 8, the AND circuits 52 and 53 receive $P_1$ in combination with $\Delta P_1$, and $P_2$ in combination with $\Delta P_2$, respectively. FIG. 11 shows the relation of the generator output P to the power variation $\Delta P$. In the region of $K_2$ ($P \geq P_2$, $\Delta P \geq \Delta P_2$), the AND circuit 52 is turned off although it receives the outputs from the comparators 33 ($P_2$) and 35 ($\Delta P_1$) because the output from the AND circuit 53 is negated by an inverter $SC_1$. The OR circuit 62 in FIG. 9 generates an output when the intercept valve becomes to have the opening $K_1$, $K_2$ which meets the relation of FIG. 11, the output serving as a reset signal for the flip-flop FF3 to hold the intercept valve at that opening. That is, in FIG. 9, the positional signal of the intercept valve is applied to comparators 41 to 43 after it has been converted to a suitable level by a level converter $L_2$. The comparators 41 to 43 set the opening positions $K_1$, $K_2$ and $K_3$ ($K_1 < K_2 < K_3$) at which the intercept valve is to be held, respectively, and generate outputs when they receive inputs having levels above these values. AND circuits 55 and 56 generate outputs due to the connection of inverters $SC_2$ and $SC_3$ when the intercept valve is held below the predetermined opening position. The OR circuit 62 generates an output to reset the flip-flop FF3 in FIG. 10 when it receives the output from either one of the AND circuits 55 and 56 (i.e., when the intercept valve reaches the level below the predetermined opening). Consequently, the intercept valve is retained at the opening position $K_1$ or $K_2$ when it reaches this opening position.

The description has been made of the operation of closing the intercept valve. In brief, the intercept valve initiates to close when the generator output undergoes the abrupt fluctuation due to the system fault, and is held at the predetermined opening depending on the generator output before the fault and the power variation. It is to be noted that any number of steps may be provided to stop the intercept valve depending on the generator output before the fault and the power variation although only those two steps ($K_1$ and $K_2$) have been provided therefor in this embodiment. Further, the closing of the intercept valve is effective for improvement in transient stability, but is required to be prevented in the generator output variation during the normal operation other than the fault because the excessive closing gives influences upon the heat power plant. For this reason, the filters 31, 32 or comparators 33 to 36 need to have, respectively, their time constant or set value selected so as to have no response to the common power variation.

Figure 12:
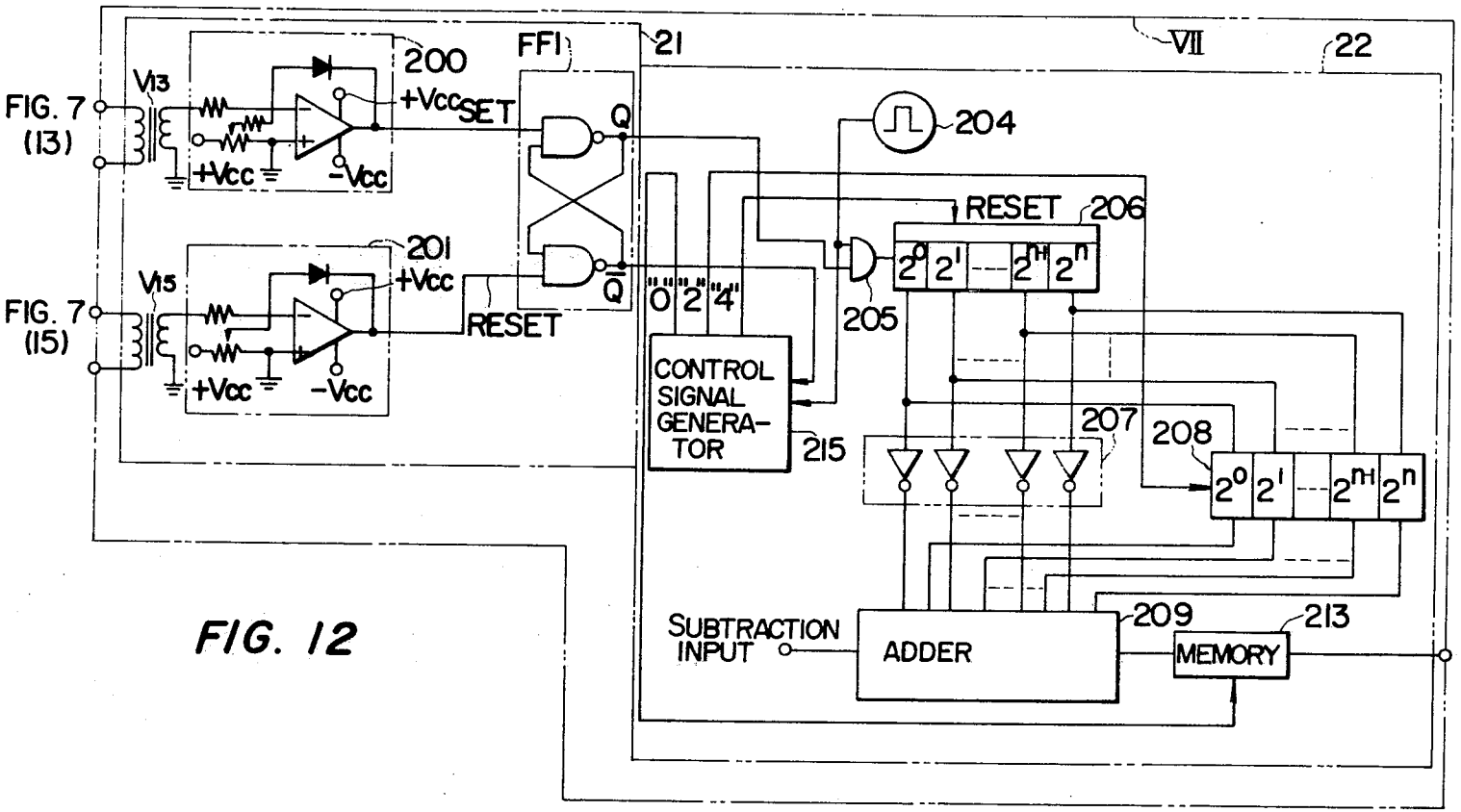
FIG. 12 is a particular circuit arrangement view of a rotor angle peak detecting block VII in FIG. 7.

On the other hand, the re-opening control of the intercept valve is initiated, as shown in FIG. 12 (illustrating the block VII), by detecting the rotor angle by means of a rotor angle detector 21 between the output voltage (internal voltage) from the pilot generator 13 and the voltage on the system side (infinite bus voltage) obtained from the transformer 15. The rotor angle detector 21 may, for example, be a circuit for generating a pulse having a duration proportional to the rotor angle between the two voltages. A peak rotor-angle detector 22 serves to detect a peak value of the fluctuation in rotor angle. In other words, the detector 22 detects the difference between the duration of the present pulse and that of the preceding pulse, both the durations being proportional to the rotor angle, and generates a signal representative of detected peak value of the rotor angle when the increasing duration of the pulse-width begins to decrease. The generation of the output from the peak rotor-angle detector 22 initiates the re-opening operation of the intercept valve. When the rotor angle takes a peak value, the acceleration force applied to the generator by the system fault is in balance with the deceleration force imparted upon the closure of the intercept valve. This control can serve to improve the transient stability as mentioned above.

The circuit having such a function may be attained in analog or digital form, but in the following a digital circuit will be particularly described in connection with FIG. 12.

Figure 13:
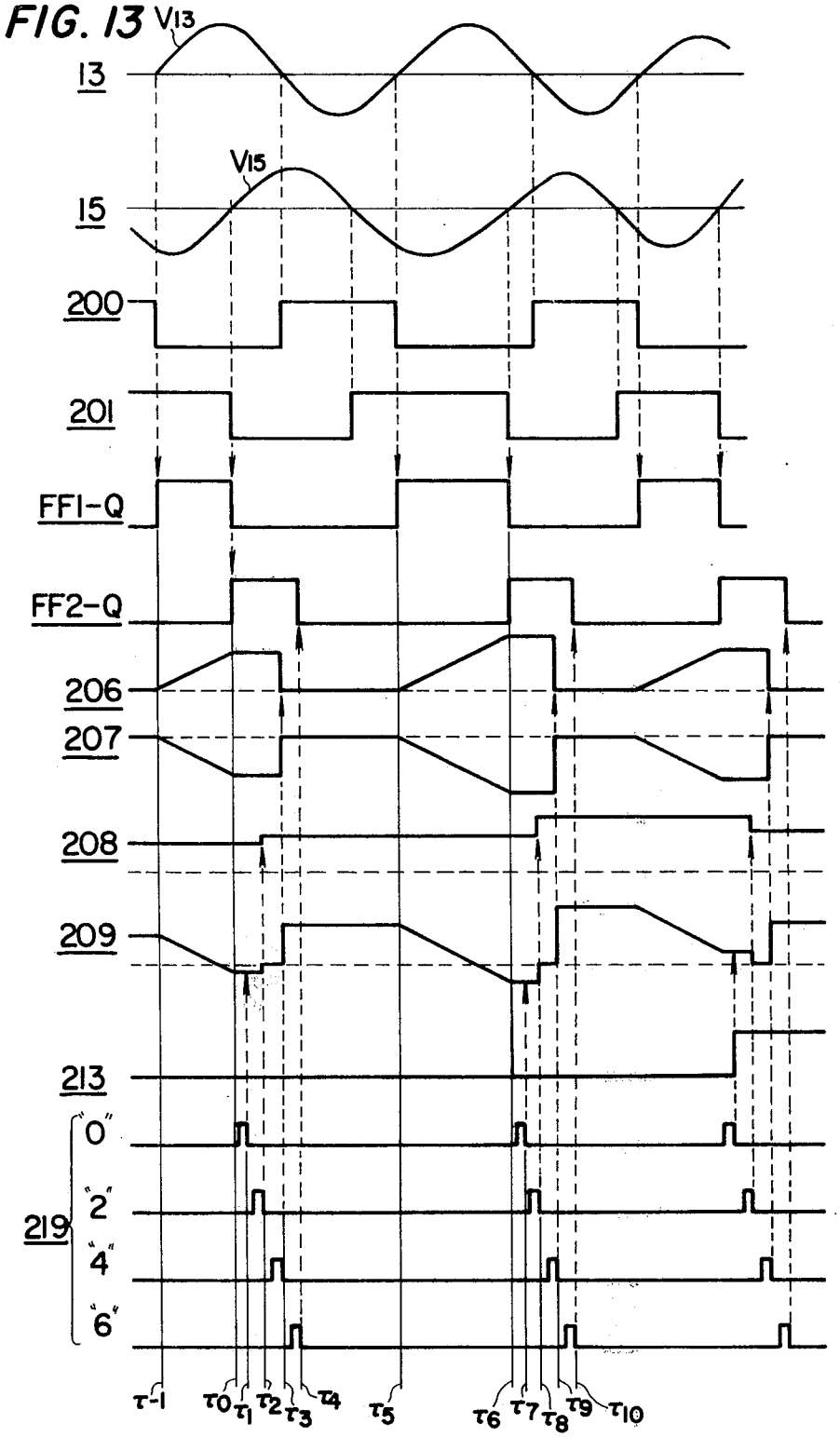
FIG. 13 is a time chart showing a time relation of outputs from each portion in FIG. 12.

First, the rotor angle detector 21 will be described which receives an internal voltage $V_{13}$ in the generator 70 and a terminal voltage $V_{15}$ (output from the transformer 15). In FIG. 13 there are shown waveforms of each portion in FIG. 12. These input voltages $V_{13}$ and $V_{15}$ are, respectively, compared with zero potential in comparators 200 and 201. The outputs from the comparators 200 and 201 set and reset a flip-flop FF1 at their falling or trailing portions, respectively. Accordingly, the flip-flop FF1 generates an output at Q during a period from a time when the voltage $V_{13}$ has changed from negative to positive to a time when the voltage $V_{15}$ has changed from positive to negative. This means a rotor angle between the voltages $V_{13}$ and $V_{15}$. The rotor angle is kept constant corresponding to the generator outputs before the fault, but fluctuates on the occurrence of the fault as mentioned in connection with FIG. 1 and other figures, thus taking the peak value.

The peak rotor-angle detector 22 comprises a clock pulse generator 204, a gate circuit 205, a counter 206 for measuring a duration of the output Q from the flip-flop FF1, an inverter 207, a register 208 for storing the output from the counter 206, an adder 209 for receiving the outputs from the inverter 207 and the register 208 to derive therefrom a difference therebetween and generating an output when the sign of the difference has changed, a memory 213, and a control signal generator 215 for providing a timing among the above-mentioned elements or devices.

Figure 14:
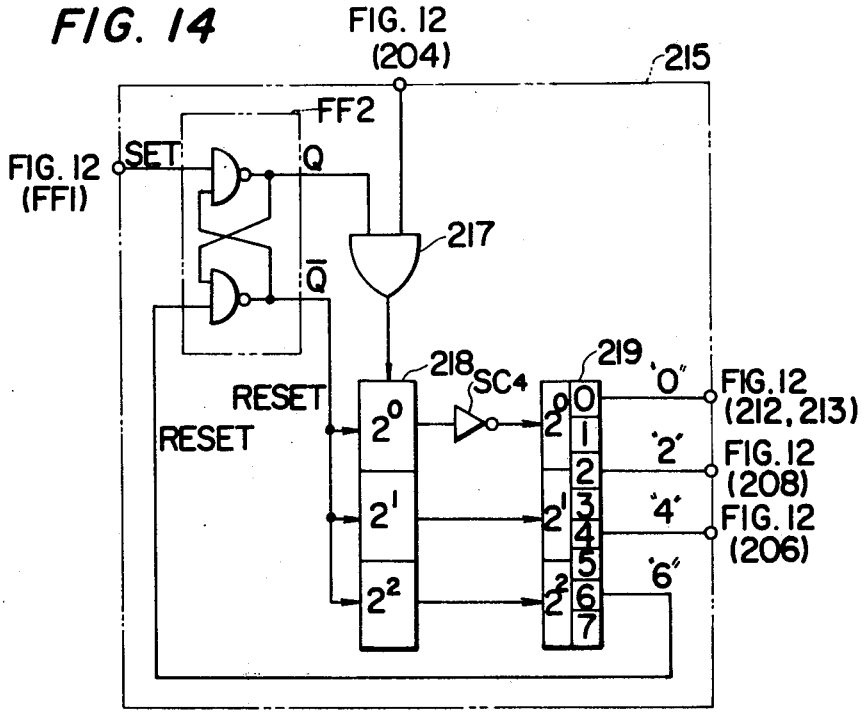
FIG. 14 is a particular circuit arrangement view of a control signal generator in FIG. 12.

The arrangement and operation of the peak rotor-angle detector 22 will be described in connection with FIGS. 13 and 14. Numerals indicated on the left side in FIG. 13 refer to the elements or devices corresponding thereto. The control signal generator 215 receives the output $\bar{Q}$ from the flip-flop FF1 and sets the flip-flop FF2 when the output $\bar{Q}$ from the flip-flop FF1 rises up. The control signal generator 215 also receives from the generator 204 the clock pulse, which is applied to a divider 218 through an AND circuit 217 only when the latter receives the output Q from the flip-flop FF2. The divider 218 is reset by the output Q from the flip-flop FF2 with each section reset to 0.

A circuit comprising the divider 218, an inverter $SC_4$ and a binary decimal decoder 219 generates timing control signals at its output positions 0, 2 and 6 at predetermined periods. In FIG. 31 there are shown these timing control signals, the decimal output 0 of which serves as a renewing signal for the memory 213, the output 2 as a renewing signal for the register 208, the output 4 as a reset signal for the counter 206 and the output 6 as a reset signal for the flip-flop FF2. The peak rotor-angle detector 22 detects the time when the rotor angle becomes a peak value (the output Q from the flip-flop FF1 corresponding to the rotor angle) in response to the above-mentioned timing control signals. It is to be noted that the outputs from the circuits 206 to 209 and 213 are represented in digital form in FIG. 12 but are illustrated in analog form in FIG. 13 for easy understanding to provide the representation of variations in outputs from each circuit. The counter 206 first counts the number of the clock pulse through the AND ciruit 205 during a time of period when the output Q from the flip-flop FF1 is 1, for example, during a period from $\tau_5$ to $\tau_6$. The counter 206 always initiates the counting of the rotor angle from the state of zero because it is reset at a time of $\tau_4$ by the timing signal 4. The rotor angle is retained in the counter 206 till a time of $\tau_9$. The output from the counter 206 is applied to the inverter 207 and the register 208. The register 208 stores the rotor angle (during a time of period of $\tau_{-1}$ to $\tau_0$) preceding one period during a time of period of $\tau_2$ to $\tau_8$ because it is renewed by the decimal output 2 of the renewal signal. The counter 206 is reset after the renewal of the register 208 has been completed. The adder 209 receives the outputs from the inverter 207 and the register 208 and derives the sign of a deviation therebetween. In other words, the adder 209 derives the deviation of the present rotor angle (the output from the counter 206) from the rotor angle preceding one period thereof (the output from the register 208), and then generates a signal representative of polarity of the deviation. The counter 206 finishes the counting of the clock pulse at the time of $\tau_0$ or $\tau_6$, and the inverter 207 receives a signal corresponding to the present rotor angle whereupon the adder 209 provides the deviation of the output of the inverter 207 from that of the register 208. The output from the adder 209, representative of the polarity of the deviation of the present rotor angle from the rotor angle preceding one period, is stored in the memory 213 at the time $\tau_1$ or $\tau_7$ in response to the decimal output 0. Assuming that the logic output from the adder 209 be 0 in the increasing rotor angle (in the negative output of the adder 209) while being 1 in the decreasing rotor angle (in the positive output of the adder 209), then the memory 213 generate the logic output 1 at and after a time when the rotor angle has shifted from increase to decrease.

As mentioned above, the time is detected when the rotor angle between the interval voltage of the generator and the infinite bus voltage reaches a peak value. The logic output from the memory 213 instructs the re-opening of the intercept valve; it is applied to an AND circuit 57 through a timer 83 of instantaneouos operation and timing restoration type in FIG. 10. At this time, the intercept valve initiates the re-opening through the OR circuit 64 receiving the signal from the AND circuit 57, which has already received from the output Q of the flip-flop FF4 the other condition that the intercept valve was instructed to close. Note that the flip-flop FF4 is set simultaneously with the flip-flop FF3. The reason why the timer 83 is of a timing restoration type is to keep the instruction of opening the intercept valve for a sufficiently long time.

As described above in detail, the intercept valve is instructed to re-open when the rotor angle reaches a peak value after it has been closed (the closure being represented by the outputs from the flip-flops FF3, FF4) on the occurrence of the fault. The reopening of the intercept valve is not effected to a full extent, i.e., to 100% opening, but restricted to the opening $K_3$ near to a full opening. Namely, the comparator 43 in FIG. 9 sets the opening $K_3$ of the intercept valve and generates the output at the level above $K_3$ to reset the flip-flop FF4. This permits no condition to be provided for the AND circuit 57, thus retaining the intercept valve at a maximum opening $K_3$. It will, however, be apparent that the flip-flop FF4 should generate the output when the output from comparator 43 appears again after it once has disappeared because the comparator 43 usually generates the output at the time of normal operation of the generator.

Figure 16:
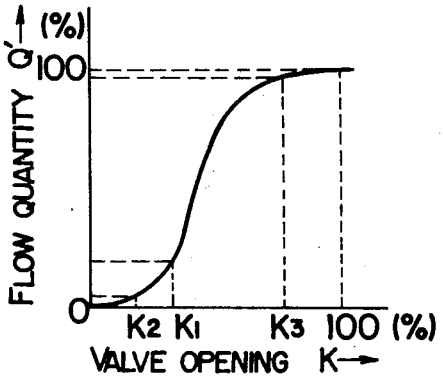
FIG. 16 is a graph showing a relation of valve-opening to flow quantity.
Figure 17:
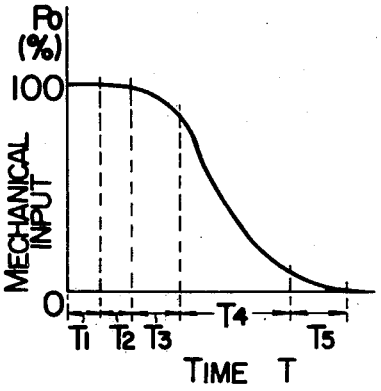
FIG. 17 is a characteristic curve showing a relation of a time required until the intercept valve is closed in terms of a mechanical input applied to a generator.

As mentioned above, the intercept valve controlling system according to the present invention is not operated to its full opening or closing, but to $K_1$ or $K_2$ when it is rendered closed and to $K_3$ when opened as shown in FIG. 16. This is intended to provide a well-controlled valve response for the intercept valve which is required to close in a short time and to open again. Thus, the well-controlled response is expected because loss times of $T_3$, $T_5$ in a valve stroke are removed. This fact is shown in FIG. 17, in which an abscissa represents a time T and an ordinate represents mechanical input power $P_0$. $T_1$ shows a delay time of the control system, $T_2$ a delay time of a valve driving device and $T_4$ a time required to perform an effective opening-closing operation of the valve. In re-opening the intercept valve, the steam flow Q' passing therethrough amounts to a full amount without particular hindrances resulting from no full opening even if th evalve is not open to a full exent but retained at the opening $K_3$.

The intercept valve control indeed makes possible the remarkable improvement in transient stability, but it is necessary to effect a backup control for compulsory re-opening with the aid of the output from the timer circuit 82 in a case where the output Q of the flip-flop FF4 continues to be generated over a predetermined time $t_2$ because the closure of the intercept valve induces the elevation of steam pressure or temperature with loads upon the reheater. The timer 82, having the characteritistic of timing operation, generates an output when the output Q from the flip-flop FF4 continues to appear over the time $t_2$.

Figure 15:
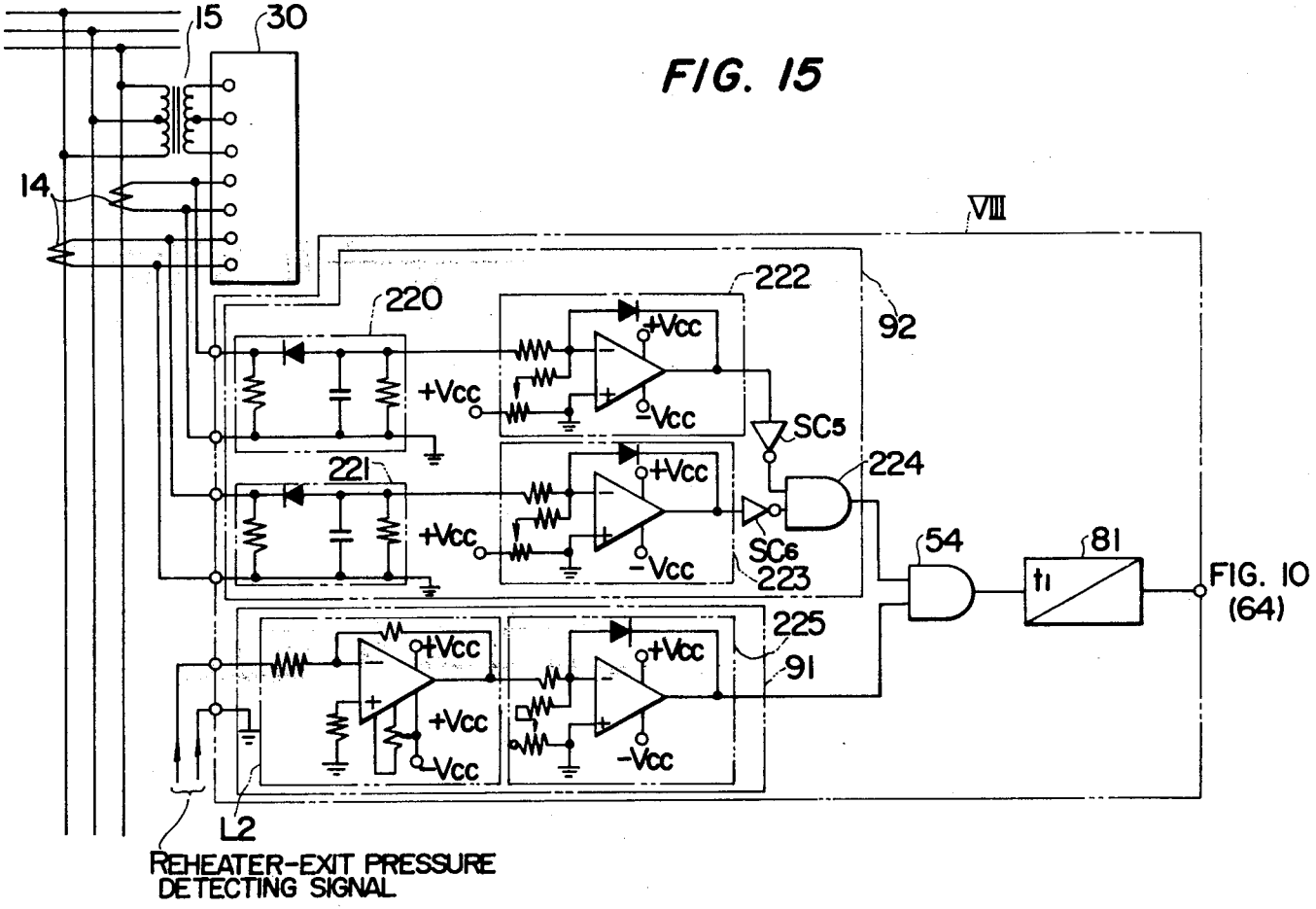
FIG. 15 is a particular circuit arrangement view of a backing up block VIII in FIG. 7.

FIG. 15 shows a particular arrangement of the backup block VIII in FIG. 7. This block serves to back up the heat power plant by opening the intercept valve in an emergency. The continuation of the intercept valve control contributes to nothing from the viewpoint of the improvement in transient stability when the generator is completely separated from the system due to the fault. The continuation of closure of the intercept valve, on the contrary, results in elevation of the steam pressure in the boiler and reheater with the danger of the heat power plant itself. The circuit shown in FIG. 15 is intended to effect the compulsory re-opening of the intercept valve and to hold the heat power plant out of operation when the steam pressure at the exit of the reheater reaches a predetermined level upon interruption of all loads.

In FIG. 15, a circuit 92 for detecting the interruption of all the loads detects the separator of the system from the generator when a generator load current derived from the current transformer 14 becomes below a predetermined level (substantially zero). This is, for example, attained by rectifying the outputs from the current transformer by means of rectifiers 220 and 221 and detecting rectified outputs below the predetermined level by means of comparators 222 and 223 and inverters $SC_5$ and $SC_6$. It is to be noted that the output from the rectifier is of negative polarity because of the connection of an AND circuit 224. A circuit 91 generates an output when the pressure at the exit of the reheater reaches a level above predetermined pressure. More specifically, the circuit 91 receives the pressure at the exit of the reheater, which is converted to a suitable voltage level for comparison with predetermined pressure (for example, 110% of rated pressure) in the comparator 225, and it generates the output at the pressure thereabove. An AND circuit 54 generates an output, which means the interruption of all the loads and the pressure above the predetermined level at the exit of the reheater. A circuit 81 serves to confirm the continuation of the output from the AND circuit 54 till a predetermined time $t_1$, and stops the turbine plant with the aid of the emergency governor and further effects the compulsory re-opening of the intercept valve through the OR circuit 64. Thus, it is possible to ensure the heat power plant to go out of operation safely upon the interruption of all the loads.

Figure 18:
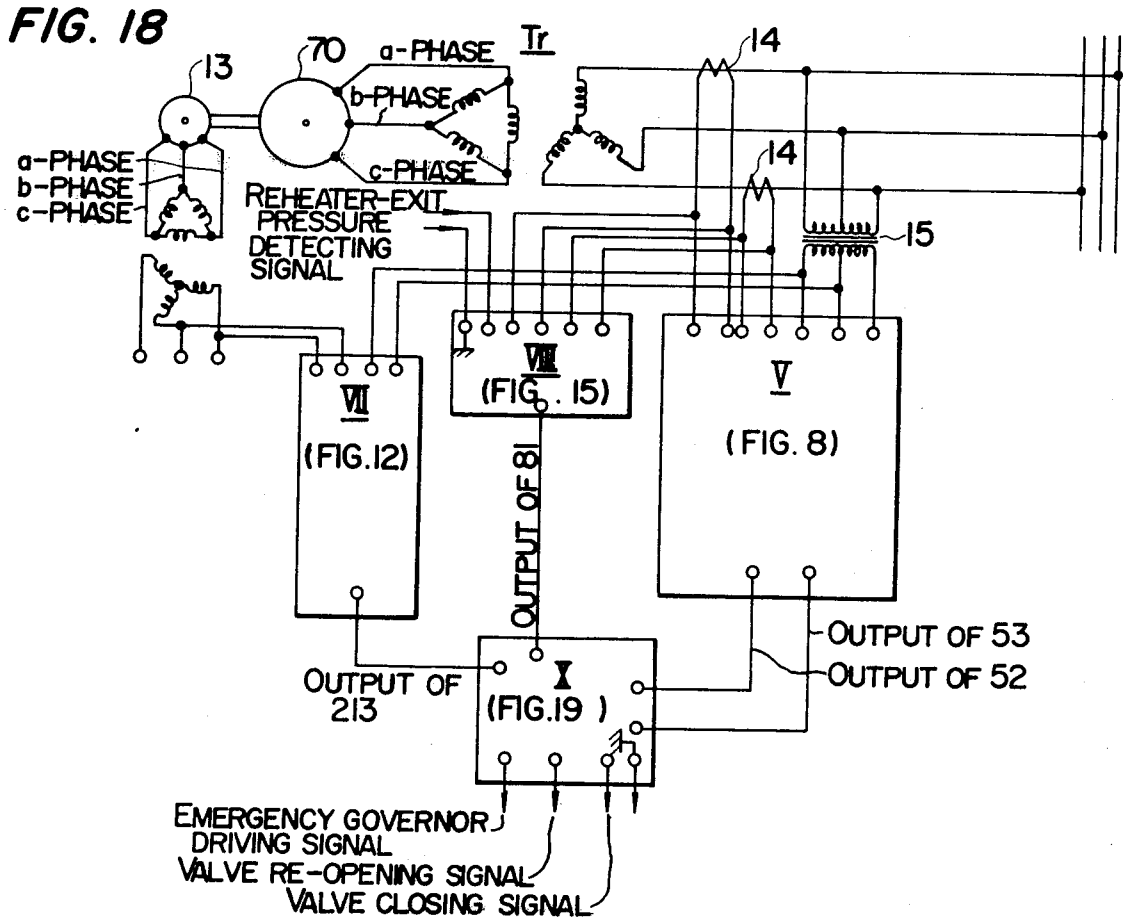
FIG. 18 is a block diagram showing a system for controlling a time till the closure of the valve in dependence on the degree of a fault.

In the embodiment of the present invention shown in FIG. 7, the opening of the intercept valve is controlled depending upon the degree of the fault, and another embodiment thereof may be conceivable as shown in FIG. 18 in which a time when the intercept valve is to be closed is determined depending upon the degree of the fault with the opening thereof kept constant.

Figure 19:
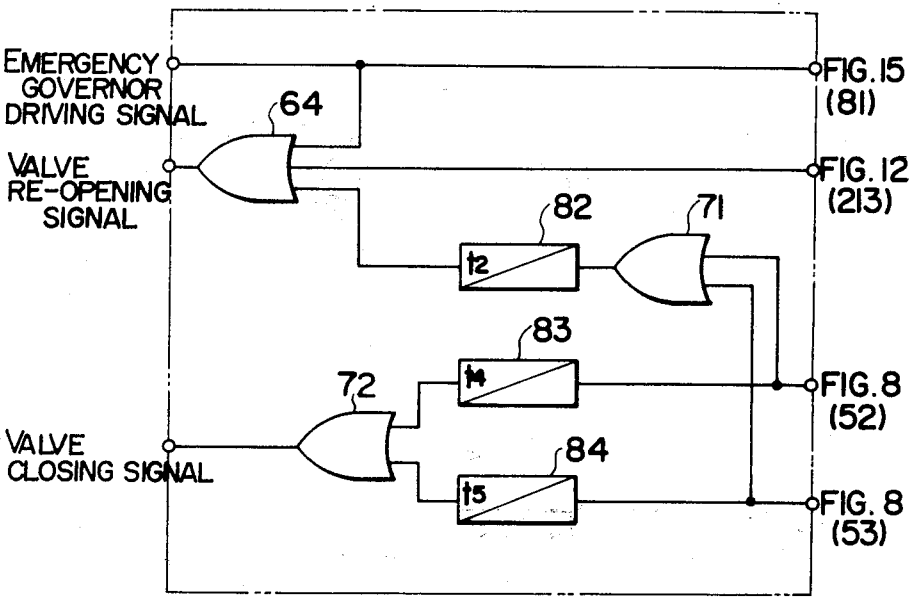
FIG. 19 is a particular circuit arrangement view of a block IX for controlling the opening and closing operation of the valve in FIG. 18.

FIG. 18 shows a block diagram which serves for improvement in transient stability by controlling a period T until intercept valve is closed. In the same figure, elements or blocks marked with the same reference marks as those of FIG. 7 indicates the same or equivalent ones. The block diagram of FIG. 18 differs from that of FIG. 7 in that the former dispenses with the block VI for setting the intercept valve at a predetermined opening position with the output from the block V applied directly to the block X. Thus, the block X corresponds to the block IX in FIG. 7. The particular circuit of the block X is shown in FIG. 19. In FIGS. 18 and 19, the variation $\Delta P$ of the generator output is detected as shown in the block V to close the intercept valve, and is combined with the output P before the occurrence of the fault to set up the characteristic as shown in FIG. 11. The characteristic, however, doesn't serve as the characteristic for the opening position of the intercept valve as shown in FIG. 7 but as a timing characteristic for determining the time when the valve is to be opened. Timer circuits 83 and 84 generate signals to close the intercept valve with time lags of $t_4$ and $t_5$ respectively after the detection of the ocurrence of the fault (the detection of the outputs from the AND circuits 52, 53 in the block V). A circuit for actually detecting the power upon the closure of the valve to provide the timing characteristics will not be described herein because it is similar to the circuit described in FIG. 7.

Further, the re-opening of the intercept valve is effected by detecting the first occurring peak value of the rotor angle in the same manner as described in FIG. 12 (no description of its circuit being made). The valve is re-opened after the elapse of a time of $t_2$ following the closure thereof to back up the reheater. Further at the time of the interruption of all the loads, the operation of the emergency governor causes the turbine to be stopped and the intercept valve to be reopened. In FIG. 19 there are shown the timers 82 to 84 of timing operation and OR circuits 64, 71 and 72.

Figure 20:
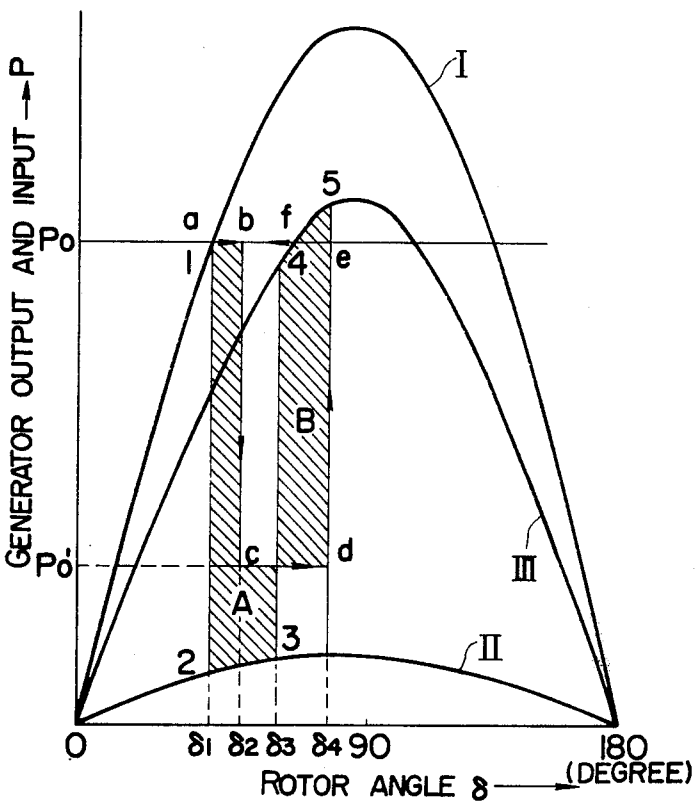
FIGS. 20 to 22 are P - δ characteristic graphs in the system of FIG. 18, showing the closure of the intercept valve at the time of a serious fault, at the time of a light fault and after the removal of a fault circuit, respectively.
Figure 22:
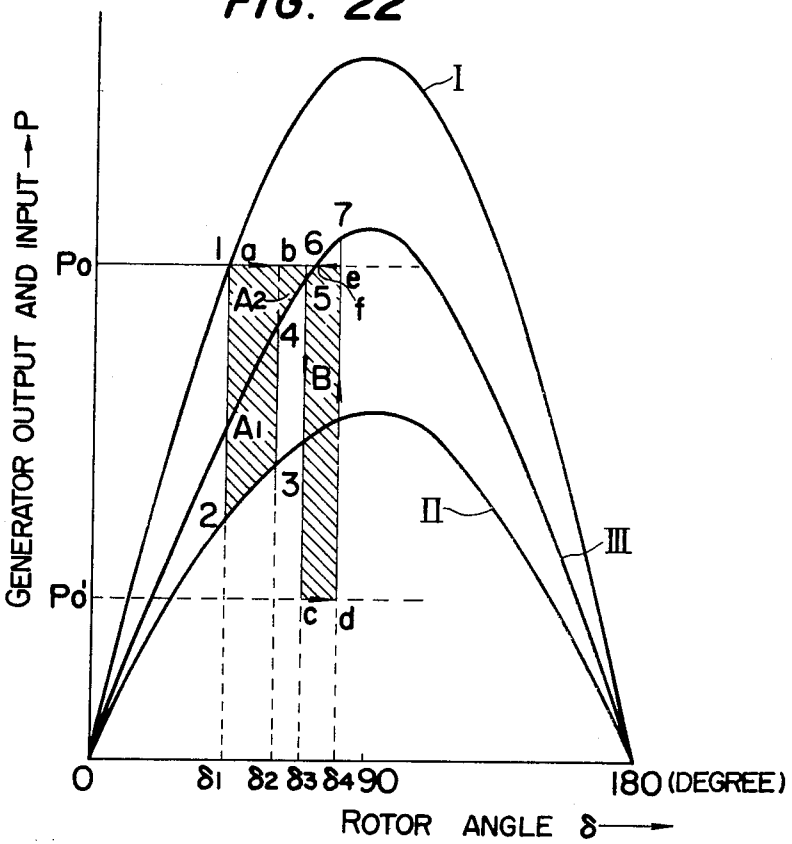
Figure 21:
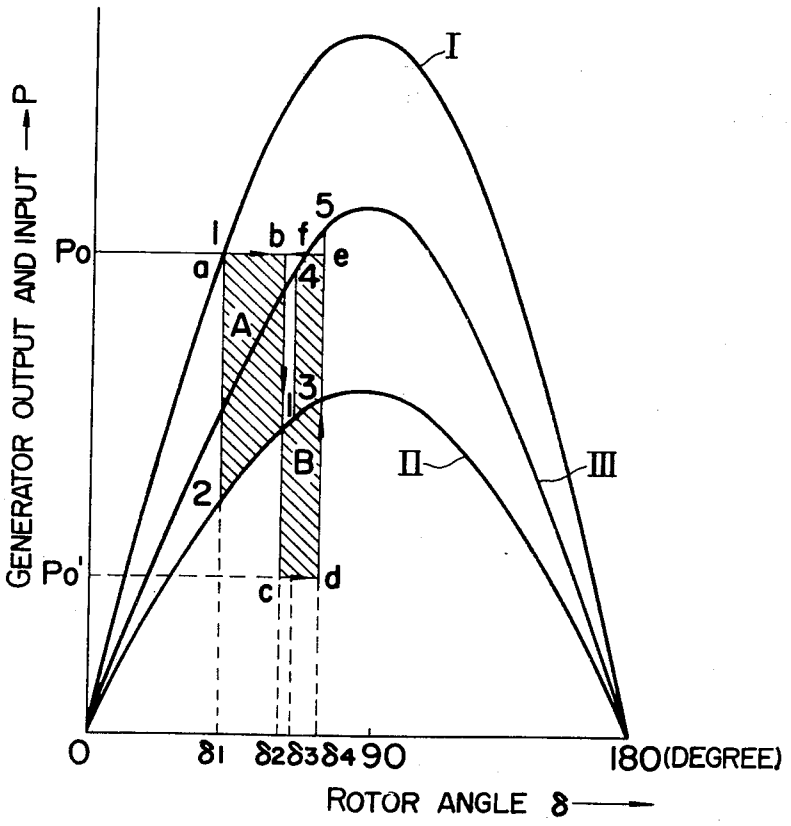

FIGS. 20 to 22 show P - $\delta$ characteristics of the embodiment of FIG. 18 in which the time to close the valve is caused to vary for improvement in transient stability with the valve opening kept constant. In the figures, elements or blocks marked with the same references as those of FIGS. 2, 5 and 6 indicate the same or equivalent ones thereof. FIG. 20 shows the P - $\delta$ characteristic curve at a time of a serious fault, FIG. 21 shows that at a time of a light fault, and FIG. 22 shows that upon the closure of the intercept valve following the removal of the fault circuit.

As described above in detail, the intercept valve cotrolling system according to the present invention permits the valve opening to be adjusted depending upon the degree of the fault and permits the time till the valve closure to be controlled depending thereupon to suppress the fluctuation in rotor angle on the occurrence of the system fault to a minumum, thus resulting in the remarkable improvement in transient stability. The valve opening or closure time is set in digital form in the embodiments of FIGS. 7 and 18, but it will be a matter of course that the same results can be obtained even if it is set in analog form.

Further, the present invention is embodied in such a way that the intercept valve is held out of control until the fault circuit is removed in order to ensure the safe controlling of the intercept valve. The invention described above relates to the intercept valve controlling system in which the intercept valve is closed in a transient time of a power system to effect an abrupt limitation to a driving fluid-medium in the intermediate turbine, thereby controlling acceleration energy applied to the generator for improvement in transient stability of the power system. For example, the variation in generator output power is detected to detect an abnormality in the system whereupon the intercept valve is closed to control the acceleration energy imparted on the generator. The opening control of the intercept valve is effected on the basis of the relation that the peak value of the fluctuation in rotor angle between the system voltage and the generator voltage following the fault appears at the time when the acceleration energy applied to the generator becomes equal to the deceleration energy applied thereto. According to this system, the intercept valve control is effected if the variation in generator output power on the occurrence of the fault is great even in a case where fused contacts of the circuit breaker obstruct the removal of the fault circuit. When, however, a serious system fault takes place and the removal of the fault circuit fails, any control system intended for improvement in transient stability brings about little effect so that the generator is usually rendered tripped. Accordingly, the failure in the removal of the fault circuit leads to the fact that the intercept valve controlling is quite useless, and thus the turbines, boiler or any other auxiliary devices tend to undergo excessive transient operations resulting from the fast-closure or opening of the intercept valve with the result of the unfavorable controlling from the viewpoints of life span and maintenance.

The present embodiment has been proposed in the light of the above-mentioned facts and is intended to effect the closing control of the intercept valve under condition of success in the removal of the fault circuit in an attempt to prevent the useless control of the intercept valve to thereby suppress the transient applied to the plant devices or apparatus to a minimum.

In brief, in the intercept valve controlling system according to the present invention, the system fault is detected by detecting the variation in generator output power resulting from the occurrence of the system fault, and the intercept valve of the turbine is abruptly closed only in a case of success in the removal of the fault circuit by cutting the associated circuit breaker off to positively apply the deceleration energy to the generator and then it is rendered open substantially at a time when the deceleration energy obtained compensates for the acceleration energy applied to the generator during a time of period from the occurrence of the fault to the removal of the fault circuit.

Figure 23:
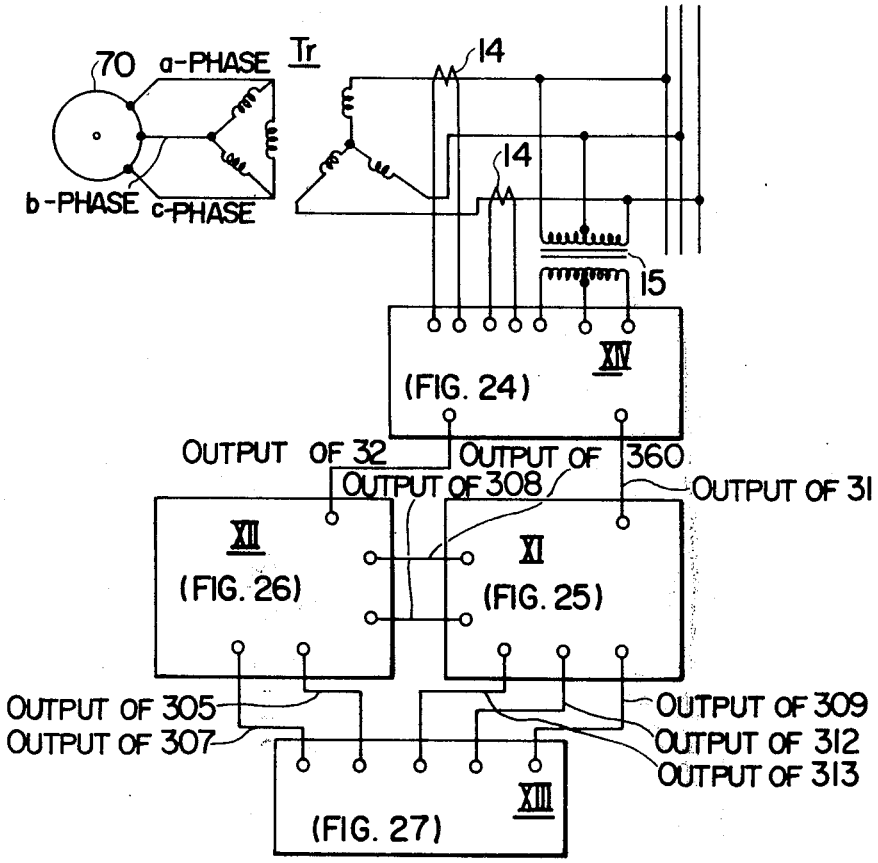
FIG. 23 is a block diagram showing a controlling system in which an intercept valve is closed under condition of the removal of a fault circuit by cutting an associated circuit breaker off, and acceleration energy applied until this time is calculated to determine a time until the valve is to be opened.
Figure 25:
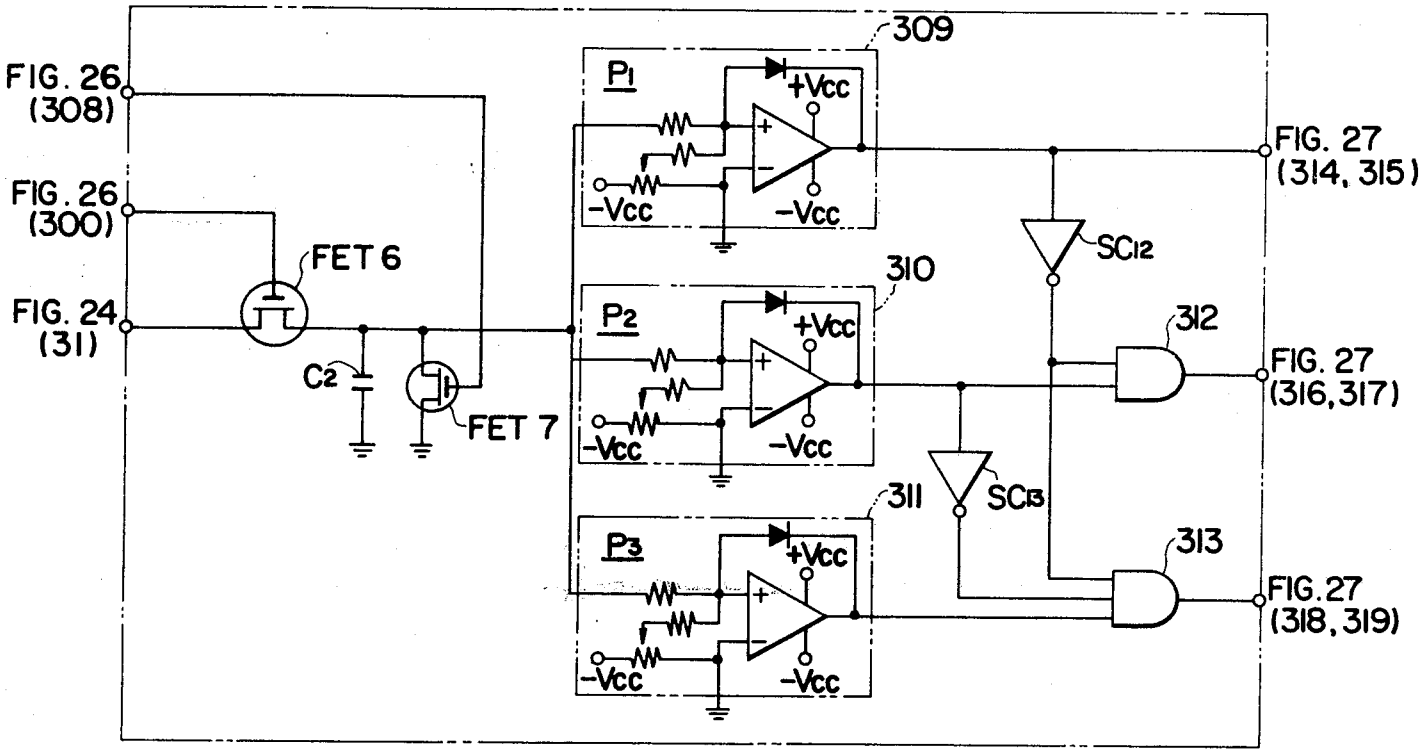
FIG. 25 is a particular circuit arrangement view of a block XI in FIG. 23.
Figure 26:
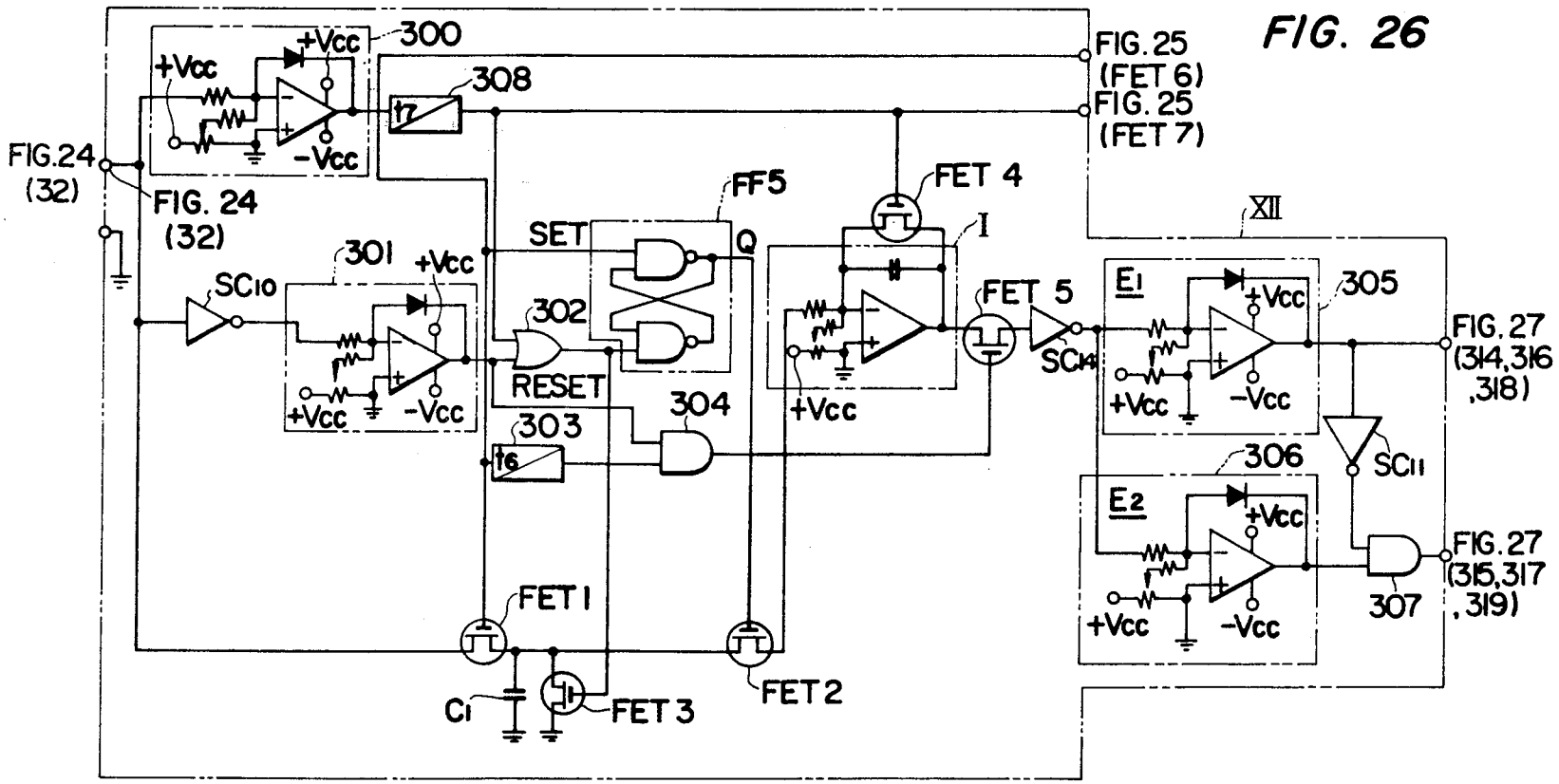
FIG. 26 is a particular circuit arrangement view of a block XII in FIG. 23.
Figure 27:
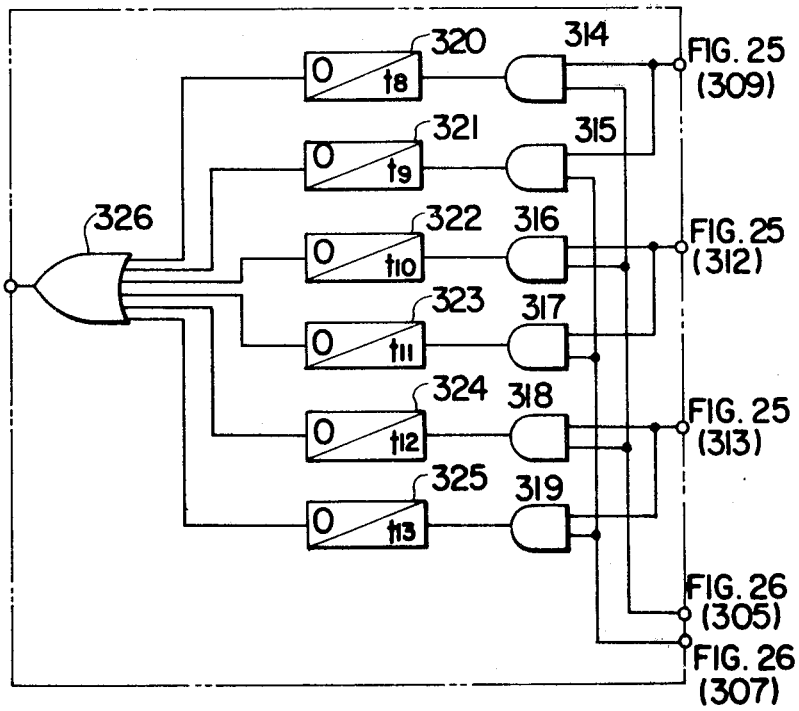
FIG. 27 is a particular circuit arrangement view of a block XIV in FIG. 23.

The functions of the present invention are shown in blocks in FIG. 23, in which elements or blocks marked with the same reference as those of FIG. 7 indicates the same or equivalent ones. In the figure, a block XIV serves to derive the generator output with its particular arrangement shown in FIG. 24. The arrangement carries out an operation similar substantially to a portion of circuits of FIG. 8, so that the detailed description is omitted. The block XIV receives the generator power and generates an output corresponding to a variattion between the respective output power before the system fault (the output from the circuit 31) and the output on the occurrence of the fault (the output from the circuit 32). The block XI serves to detect how large the output power is immediately before the fault, and the particular circuit arrangement thereof is shown in FIG. 25. The block XII serves to detect the acceleration energy applied to the generator during the continuation of the fault (from the occurrence of the fault to the success in the removal of the fault circuit), the particular circuit arrangement being shown in FIG. 26. The block XIII serves to control a time during which the intercept valve is closed after the success in the removal of the fault circuit on the basis of the output power immediately before the fault (the output of FIG. 25) and the acceleration energy (the output of FIG. 26) applied to the genenrator during the system fault. The particular circuit arrangement of the block XIII is shown in FIG. 27.

As mentioned above, the present embodiment is intended to effect the intercept valve control for the first time under condition of the success in the removal of the fault circuit and to calculate the acceleration energy applied to the generator during the system fault to thereby obtain the optimum time to close the intercept valve.

This embodiment will be fully described in connection with the drawings. The block XIV will not be described because it will be apparent from FIG. 8. Referring next to FIG. 26, the circuit of the block XII serves to derive the accelaration energy applied to the generator during the fault from the power variation (the output from the circuit 32) at the time of the fault which is obtained in FIG. 24. In FIG. 26, the power variation is applied to a comparator 300, which generates an output upon reception of an input above a set voltage. The output from the comparator 300 means the occurrence of a fault, and it is applied to the gate of a gate circuit FET1 such as an FET (Field Effect Transistor) to render it conductive to thereby store a power variation (the output from the detector 32) on a capacitor C1. Further the output from the comparator 300 sets at its rising portion a flip-flop FF5, the terminal Q of which (generating an output 1 in response to a set input) renders the gate circuit FET2 conductive to apply the power variation stored on the capacitor C1 to an integrator I. Thus, the integrator I initiates the integration of the power variation. The value of the integration means the acceleration energy applied to the generator. On the other hand, a comparator 301 similar to the comparator 300 receives the power variation through an inverter $SC_{10}$. As shown also in FIG. 2, the success in the removal of the fault circuit causes the generator to increase in output power and hence the output of the inverter $SC_{10}$ to decrease. The output of the inverter $SC_{10}$ greater than that level of the comparator 301 which is to be compared causes the comparator 301 to generate an output of a high level. The flip-flop FF5 is reset through an OR circuit 302 by the rising portion of the output from the comparator 301 to generate an output, which renders the transistor FET2 non-conductive. The output from the OR circuit 302 causes the FET2 to render the FET3 conductive to short-circuit the capacitor $C_1$. As a result, the integrator I integrates the power variation from the time of the occurrence of the fault to the time of the removal of the fault circuit. This integration value represents the acceleration energy applied to the generator during this period. It is to be noted that the transistor FET1 is made non-conductive when the comparator 301 ceases to generate its output (substantially at the same time of the success in the removal of the fault circuit). The output of the integrator is applied to the following circuit for the first time under condition of the success in the removal of the fault circuit after the lapse of a predetermined time $t_6$ from the occurrence of the fault. In other words, a circuit including a timer 303 of timing restoration, an AND circuit 304 and a gate circuit FET5 serves to apply the integrator output to comparators 305 and 306 when the above mentioned condition is fulfilled. It is not always necessary to provide the timer 303 because the conduction of the FET5 may be performed by the condition of success in the removal of the fault circuit. The timer 303 is provided for imparting a valve opening instruction only at the time of the fault. The comparators 305 and 306 generate outputs when the generator receives the acceleration energies above $E_1$ and $E_2$ ($E_1 > E_2$), respectively. The output voltage from the integrator is positive (because the negative output voltage from the filter 32 on the occurrence of the fault is converted to be positive through the integrator), so that it is converted to be negative by an inverter $SC_{14}$ and then applied to the input terminals of the comparators 305, 306. An inverter $SC_{11}$ and an AND circuit 307 cause the output from the comparator to be prevented from being generated when the comparator 305 generates the output because of a relation of $E_1 > E_2$, thus permitting the output to be derived from either one of the comparators. In FIG. 26, a timer 308 of timing operation serves to provide compulsory resetting of the flip-flop FF5 through the OR circuit 302 after sufficient time $t_7$ elapses from the occurrence of the fault (at the time when the comparator 300 generates the output) and to render the gates circuit FET4 conductive to discharge the integrating capacitor of the integrator I.

The circuit for detecting the level of the generator output power immediately before the fault was shown in FIG. 25, in which gate circuits FET6 and FET 7 and a capacitor $C_2$ correspond to the gate circuits FET1 and FET3 and the capacitor $C_1$, respectively. The gate circuit FET 6 receives at its gate the output from the comparator 300 to controll a charging period of the capacitor $C_2$ while the gate circuit FET7 receives at its gate the output from the timer 308 to control a discharging period of the capacitor $C_2$. The capacitor $C_2$ receives the output from the filter 31 of a large time constant, so that it holds the generator output immediately before the fault. Comparators 309, 310 and 311 similar to the comparators 300 and 301 generate outputs when they receive signals above comparative values $P_1 > P_2 > P_3$, respectively. A circuit including inverters $SC_{12}$, $SC_{13}$ and AND circuits 312, 313 serves to obtain either one of the outputs from the comparators 309 to 311 by cutting off the other two when the comparator having a higher comparative voltage generates the output on the assumption that the comparators 309 to 311 generate the outputs having a relation of $P_1 > P_2 > P_3$.

Figure 28:
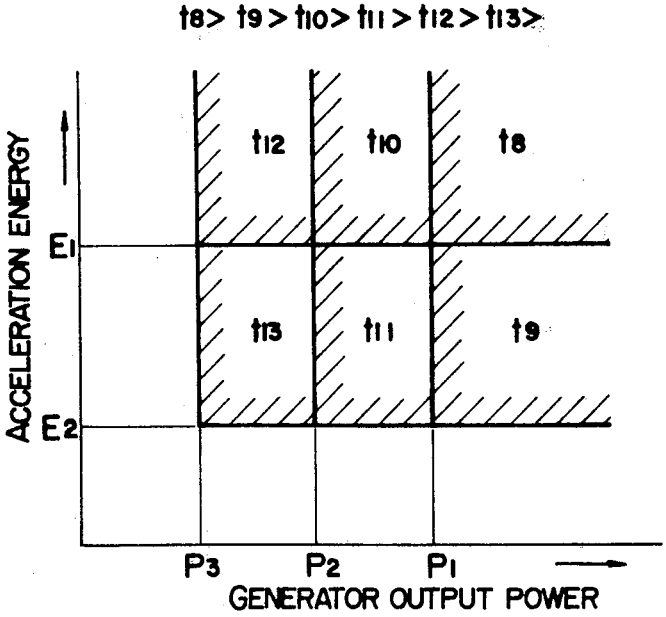
FIG. 28 is a timing characteristic graph for illustrating how a time is determined until a valve is again opened in dependence on a magnitude of acceleration energy applied to a generator.

FIG. 27 shows a logic circuit for deriving a time of period of closing the intercept valve from those power levels $P_1$, $P_2$, $P_3$ before the fault which are obtained in FIG. 25 and from those acceleration energies $E_1$, $E_2$ during the continuation of the fault which are obtained in FIG. 26. In other words, the logic circuit of FIG. 27 closes the intercept valve at the time of the success in the removal of the fault circuit to generate a deceleration force which compensates for the acceleration force. In this case, however, no optimum period of the closure causes suitable deceleration force to be obtained, thus resulting in disturbance of the transient stability of the system. In FIG. 27 there are shown AND circuits 314 to 319, timers 320 to 325 of instantaneous operation and timing restoration, and an OR circuit 326. The characteristics of the logic circuit of FIG. 27 are shown in FIG. 28, in which the abscissa indicates the generator output P and the ordinate indicates the acceleration energy E with respective timings selected to be $t_8 > t_9 > t_{10} > t_{11} > t_{12} > t_{13}$. It is to be noted that the timing relations depend upon the degree of the fault and hence are not necessarily chosen as mentioned above. The relation of $t_8 > t_{13}$ will be apparent, but the relation of $t_9$ to $t_{10}$ may be $t_9 > t_{10}$ or $t_9 < t_{10}$. This depends upon which is of more importance, the output prior to the fault or the acceleration energy, in deciding the timing characteristics taking into consideration the degree of the fault.

As mentioned above, the embodiment of FIG. 23 permits any unuseful control of the intercept valve not to be effected unless the removal of the fault circuit succeeds because the intercept valve is controlled to close under condition of the removal of the fault circuit. For this reason, no transient disturbance is imparted on the turbine, boiler and auxiliary devices of the plant with more effective operation of the plant and with expected advantages from the viewpoints of lifespan and maintenance because of a minimum adverse influence upon the turbine, boiler and auxiliary devices.

Further, the intercept valve which has been once closed is again opened when the acceleration energy applied to the generator during the period of the fault becomes in equilibrium with the deceleration energy applied thereto after the removal of the fault circuit, so that the fluctuation in generator rotor angle following the first peak is permitted to be suppressed as small as possible.

Figure 24:
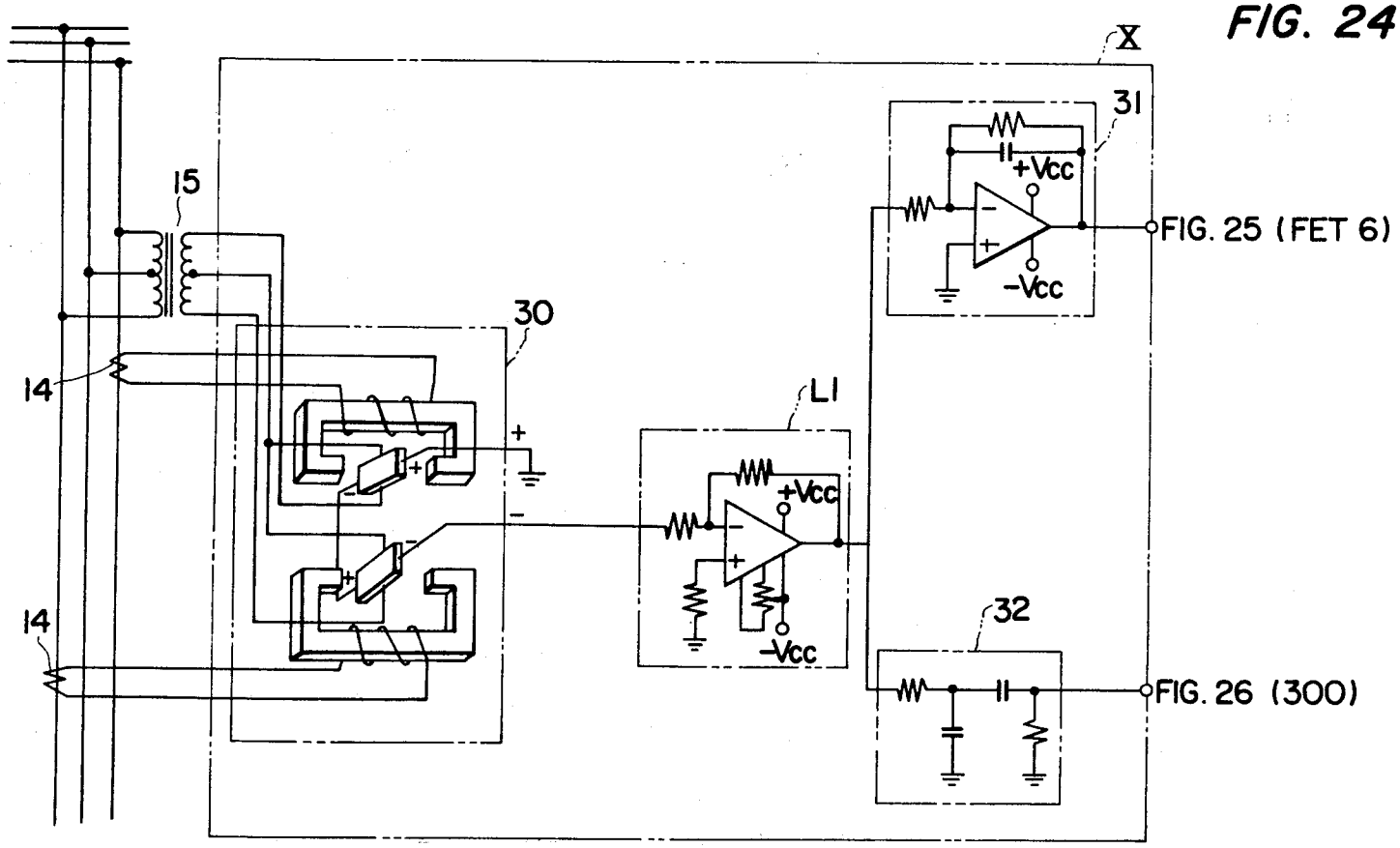
FIG. 24 is a particular circuit arrangement view of a block XIV in FIG. 23.

In the embodiment of the present invention as shown in FIG. 24, the signal for detecting whether the removal of the fault circuit has succeeded is derived from the variation in generator output power at the time of the removal of the fault circuit, but may be produced using a control signal from the circuit breaker or protective relay.

Further, in the present embodiments, the period during which the intercept valve is closed is determined in six levels in combination of three kinds of levels as to the normal generator output and two kinds of levels as to the acceleration energies applied to the generator during the fault, and the number of the levels to be detected and combination thereof will be selected at will with the result that the time to re-open the intercept valve is obtained more accurately.

As mentioned above, various kinds of the intercept controlling methods have been described in conjunction with the accompanying drawings. In brief, the intercept controlling method according to the present invention comprises the steps of closing and opening the intercept valve taking into consideration the equilibrium of energy. For the closure of the valve there have been proposed the method for closing the valve on the occurrence of the fault and the method for doing same after success in the removal of the fault circuit. For the opening of the valve, on the other hand, there have been proposed the method for opening the valve by supervising the actual rotor angle and the method by calculating the acceleration force. Two possible combinations of four valve opening and closing controls are shown in FIGS. 7 and 24, respectively, with further two other combinations, one of which is a method for closing the valve under condition of the removal of the fault circuit and re-opening same under condition that the rotor angle reaches the first peak value. The other method is to calculate the acceleration energy at the same time when the valve is closed under condition of the occurrence of the fault and to obtain a period from the time during which the acceleration energy is applied till the removal of the fault circuit to the time until the valve is re-opened. It is, however, not easy to calculate the acceleration energy in the latter method in contrast to the method of FIG. 23. It is of importance that the acceleration energy is to be derived from the difference between the mechanical input and the electric output; however skill is required for measurement of the mechanical input because of the closed valve on the occurrence of the fault. It is, however, possible to obtain the acceleration energy from the difference between the electric output and the mechanical input, which is, for example, estimated from the opening of the intercept valve. Further, in addition, the various control methods for closing the valve or for backing up the plant have been proposed in the present invention. These control methods can be carried out at will in association with the valve opening and closing methods with any possible combination. It is, however, needless to say that any possible combination thereof doesn't always lend itself to excellence from the viewpoints of technique, economy or reliability, but requires various examinations when it is carried out.

What is claimed is:

1. An intercept valve controlling method adapted for use in a heat power plant having a turbine plant including a highpressure turbine and an intermediate-pressure turbine; a generator; a reheater and an intercept valve both disposed between the high-pressure and intermediate-pressure turbines; and transmission system including at least two transmission circuits on an output bus from the generator; said method comprising the steps of closing said intercept valve upon the occurrence of a fault on said transmission system; and thereafter opening said intercept valve when the inner rotor angle of said generator reaches a first peak value.

2. An intercept valve controlling method as set forth in claim 1, wherein the closure of said intercept valve is effected when a transmission circuit on which the fault has occurred is successfully removed.

3. An intercept valve controlling method as set forth in claim 1, wherein said intercept valve is rendered open when a time elapses which is determined by the opening of said intercept valve and the acceleration force applied to said generator.

4. An intercept valve controlling method as set forth in claim 1, wherein said turbine plant is rendered out of operation and said intercept valve is forced to open when all loads on said transmission system are interrupted.

5. An intercept valve controlling method as set forth in claim 1, wherein said intercept valve is closed to a certain opening depending upon the degree of the system fault.

6. An intercept valve controlling method as set forth in claim 1, wherein a time lag from the occurrence of the system fault to the closure of said intercept valve is determined depending upon the degree of the system fault.

7. An intercept valve controlling method as set forth in claim 1, wherein the occurrence of the system fault is detected by the fact that the output of said generator abruptly decreases an amount exceeding a predetermined level.

8. An intercept valve controlling method as set forth in claim 2, wherein the success in the removal of the fault circuit is detected by the fact that the output of said generator abruptly increases an amount exceeding a predetermined level after it has abruptly decreased an amount exceeding a predetermined level.

9. An intercept valve controlling method as set forth in claim 5, wherein the opening to be determined in dependence on the degree of the system fault is determined by the output of said generator immediately before the occurrence of the system fault and the degree of the variation in the output of said power plant resulting from the system fault.

10. An intercept valve controlling method as set forth in claim 6, wherein said time lag is determined depending upon the output of said generator immediately before the occurrence of the system fault and the degree of the variation in the output of said power plant resulting from the system fault.

11. An intercept valve controlling system adapted for use in a heat power plant having a turbine plant including a high-pressure turbine and intermediate-pressure turbine; a generator; a reheater and an intercept valve both disposed between the high-pressure and intermediate-pressure turbines; and transmission system including at least two transmission circuits on an output bus from the generator; said controlling system comprising failure detecting means for producing an output upon the occurrence of a fault on said transmission system; valve closing means for closing said intercept valve in response to the output of said failure detecting means; inner rotor angle detecting means for detecting the inner rotor angle of said generator so as to produce an output when the inner rotor angle reaches a first peak value; and valve opening means for opening said intercept valve in response to the output of said inner rotor angle detecting means.

12. An intercept valve controlling system as set forth in claim 11, further comprising a current detector for generating an output when the load current of said generator decreases down to a predetermined level, and a pressure detector for generating an output when the pressure at the exit of said reheater increases up to a predetermined level, whereby both the detectors being operated to generate the outputs to drive an emergency governor for the turbines is driven to thereby stop the turbine plant and open said intermediate intercept valve when both said current detector and said pressure detector generate their outputs simultaneously.

13. An intercept valve controlling system as set forth in claim 11, wherein said inner rotor angle detecting means includes first means for deriving respective voltages at two desired points on respective lines of said transmission circuits; second means for obtaining an output corresponding to the rotor angle between said respective two voltages; and third means for producing an output when the output of said second means reaches the first peak value.

14. An intercept valve controlling system as set forth in claim 11, wherein said inner rotor angle detecting means includes means for calculating acceleration energy supplied to said generator during the continuation of the fault occurring on said transmission system from the input to and output from said generator; and timing means for producing an output when a period of time corresponding to the output of said acceleration energy calculating means elapses, the output of said timing means being the output of said inner rotor angle detecting means.

15. An intercept valve controlling system as set forth in claim 11, wherein said failure detecting means produces said output immediately after a fault occurs on said transmission system.

16. An intercept valve controlling system as set forth in claim 11, wherein said failure detecting means produces said output when a fault on said transmission system is removed.

17. An intercept valve controlling system as set forth in claim 16, wherein the removal of the fault on a transmission circuit is detected by the fact that a circuit breaker for said transmission system is opened.

18. An intercept valve controlling system as set forth in claim 11, wherein said failure detecting means functions to obtain a difference between the respective generator outputs after and before the occurrence of a fault, and said valve closing means closes the valve to a predetermined opening in accordance with said difference between the respective generator outputs after and before the occurrence of a fault.

19. An intercept valve controlling system as set forth in claim 11, wherein said failure detecting means includes first means for obtaining a difference between the respective generator outputs after and before the occurrence of the fault and timing means for producing an output after a lapse of time in accordance with the output of said first means, the output of said timing means being the output of said failure detecting means.

20. An intercept valve controlling system as set forth in claim 15, wherein said failure detecting means includes first means following the output of said generator with a lapse of time, second means immediately following the output of said generator, third means for obtaining a difference between the respective outputs of said first and second means, and fourth means for producing an output when the output of said third means exceeds a predetermined value with a given polarity.

21. An intercept valve controlling system as set forth in claim 16, wherein said failure detecting means includes first means following the output of said generator with a lapse of time, second means immediately following the output of said generator, third means for obtaining a difference between the respective outputs of said first and second means, and fourth means for producing an output when the output of said third means exceeds a predetermined value with a given polarity.

* * * * *